US008364060B2

(12) United States Patent
Sato

(10) Patent No.: US 8,364,060 B2
(45) **Date of Patent: *Jan. 29, 2013**

(54) IMAGE FORMING APPARATUS AND CARTRIDGE FOR THE USE THEREWITH

(75) Inventor: Shougo Sato, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/240,267

(22) Filed: Sep. 22, 2011

(65) Prior Publication Data

US 2012/0008981 A1 Jan. 12, 2012

Related U.S. Application Data

(63) Continuation of application No. 12/040,205, filed on Feb. 29, 2008, now Pat. No. 8,045,886.

(30) Foreign Application Priority Data

Mar. 1, 2007 (JP) ..... 2007-051420

(51) Int. Cl.
*G03G 15/08* (2006.01)

(52) U.S. Cl. ..... 399/119; 399/262

(58) Field of Classification Search ..... 399/107, 399/110, 111, 119, 125, 258, 260, 262
See application file for complete search history.

(56) References Cited

U.S. PATENT DOCUMENTS

| | | | | |
|---|---|---|---|---|
| 7,657,206 | B2 | 2/2010 | Sato | |
| 8,045,886 | B2 * | 10/2011 | Sato | 399/119 |
| 2006/0210302 | A1 * | 9/2006 | Song | 399/111 |
| 2007/0048009 | A1 * | 3/2007 | Izumi et al. | 399/119 |

FOREIGN PATENT DOCUMENTS

| | | |
|---|---|---|
| JP | 06-035244 | 2/1994 |
| JP | 06-194886 | 7/1994 |
| JP | 10-133526 | 5/1998 |

OTHER PUBLICATIONS

Office Action for corresponding Japanese Patent Application 2007-051420 mailed on Sep. 6, 2011.

* cited by examiner

*Primary Examiner* — Susan Lee
(74) *Attorney, Agent, or Firm* — Banner & Witcoff, Ltd.

(57) ABSTRACT

An image forming apparatus and a cartridge for use therewith are provided. The image forming apparatus includes a main body; a cartridge that stores a developer; a supporting member that receives the cartridge; and a side cover that covers the supporting member, where the supporting member is rotatably supported by the main body. The supporting member pivots between a reception position at which the cartridge is received into the main body and an exposure position at which the cartridge is exposed from the main body.

19 Claims, 15 Drawing Sheets

IMAGE FORMING APPARATUS AND CARTRIDGE FOR THE USE THEREWITH

CROSS REFERENCE TO RELATED APPLICATION

The present application claims priority to U.S. Ser. No. 12/040,205, filed Feb. 29, 2008, which claims priority from Japanese Patent Application No. 2007-051420, which was filed on Mar. 1, 2007, the disclosures of which are herein incorporated by reference in their entirety.

TECHNICAL FIELD

Apparatuses consistent with the present invention relate to image formation and, more particularly, to an image forming apparatus such as a laser printer and a cartridge for use therewith.

BACKGROUND

In Japanese Unexamined Patent Application Publication No. H6-194886, a related art color image forming apparatus has been suggested in which a process cartridge is drawn out from the related art color image forming apparatus, and the process cartridge includes therein a photosensitive belt, developing devices disposed below the process cartridge to store color developers, and a cleaning unit.

In the related art color image forming apparatus, toner hoppers of each color are fitted to the developing devices so as to interfere with each other in the drawing direction of the process cartridge. At a time of drawing out the process cartridge from the related art color image forming apparatus, the toner hoppers are first drawn out of the image forming apparatus and then the process cartridge is drawn out of the image forming apparatus.

SUMMARY

In the related art color image forming apparatus, the toner hoppers are arranged in parallel and can be drawn out upward from the corresponding developing devices.

However, when the toner hoppers are configured to be drawn out, a space for storing the drawn toner hoppers is required in the drawing direction of the toner hoppers. Accordingly, there is a disadvantage in the related art color image forming apparatus in that space cannot be utilized effectively.

Illustrative aspects of the present invention address the above disadvantages and other disadvantages not described above. However, the present invention is not required to overcome the disadvantages described above, and thus, an illustrative aspect of the present invention may not overcome any of the problems described above.

It is an aspect of the present invention to provide an image forming apparatus which can allow smooth attachment and detachment of a cartridge and which can effectively utilize a space adjacent to the cartridge.

According to an illustrative aspect of the present invention, there is provided an image forming apparatus comprising a main body; a cartridge that can be attached to and detached from the main body and that stores a developer; and a supporting member that is disposed in the main body and that receives the cartridge, an end of the supporting member being rotatably supported by the main body, wherein the supporting member pivots between a reception position at which the cartridge is received into the main body and an exposure position at which the cartridge is exposed from the main body.

According to another illustrative aspect of the present invention, there is provided a cartridge for use with an image forming apparatus, the cartridge comprising an inner chassis that stores a developer and that has an opening allowing the developer to pass through; an outer chassis comprising a shutter member that opens and closes the opening, the outer chassis receiving the inner chassis wherein the shutter member can move relative to the inner chassis; a first protrusion provided at one of the inner chassis and the outer chassis; and a second protrusion provided at the other of the inner chassis and the outer chassis, wherein the first protrusion and the second protrusion of the cartridge engage with the image forming apparatus, such that one of the first and second protrusions is moved and the other of the first and second protrusions is regulated, based on a position of the cartridge with respect to the image forming apparatus.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

1. Image Forming Apparatus

Figure 1:
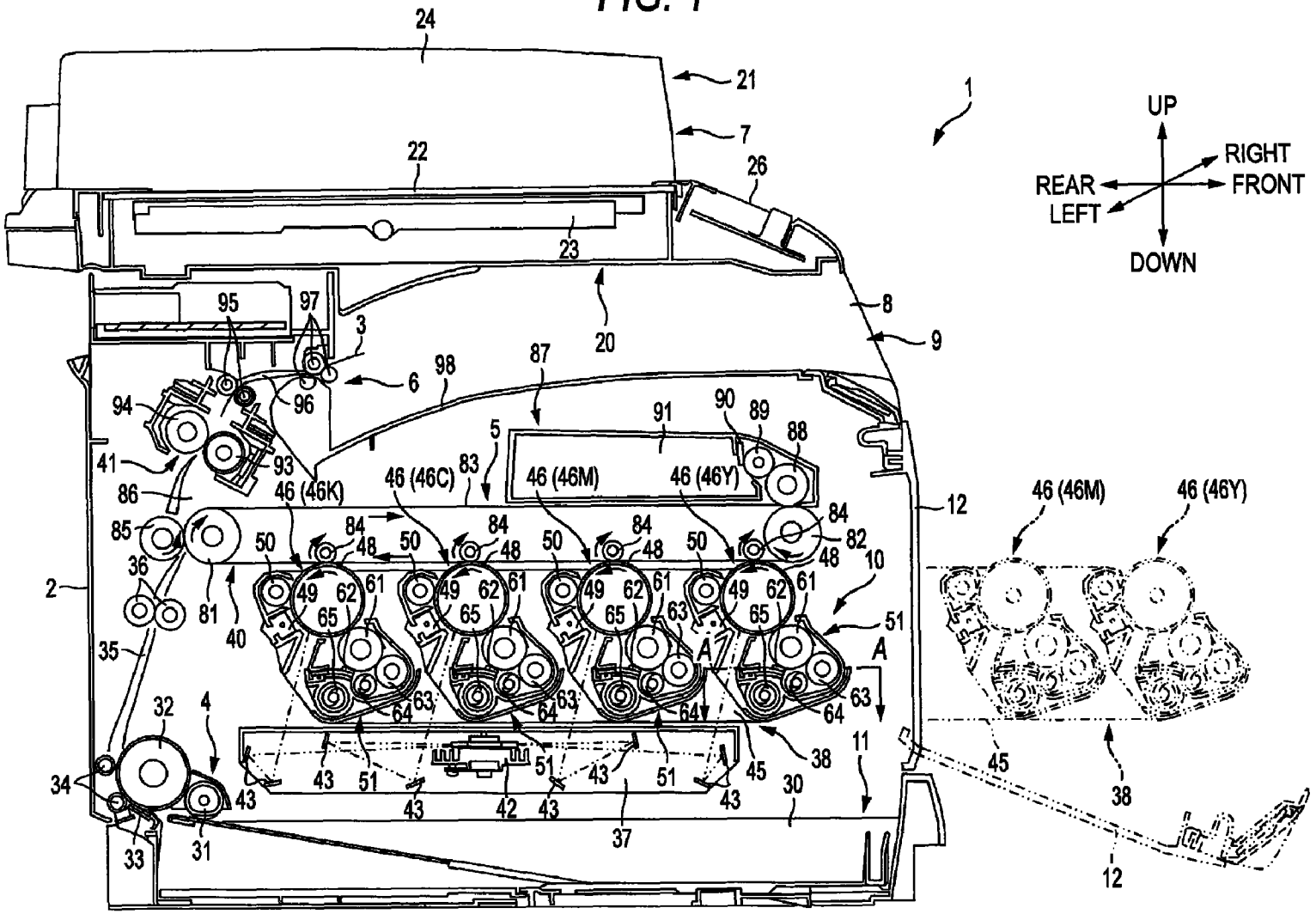
FIG. 1 is a side sectional view illustrating an image forming apparatus according to an exemplary embodiment of the present invention.
Figure 2:
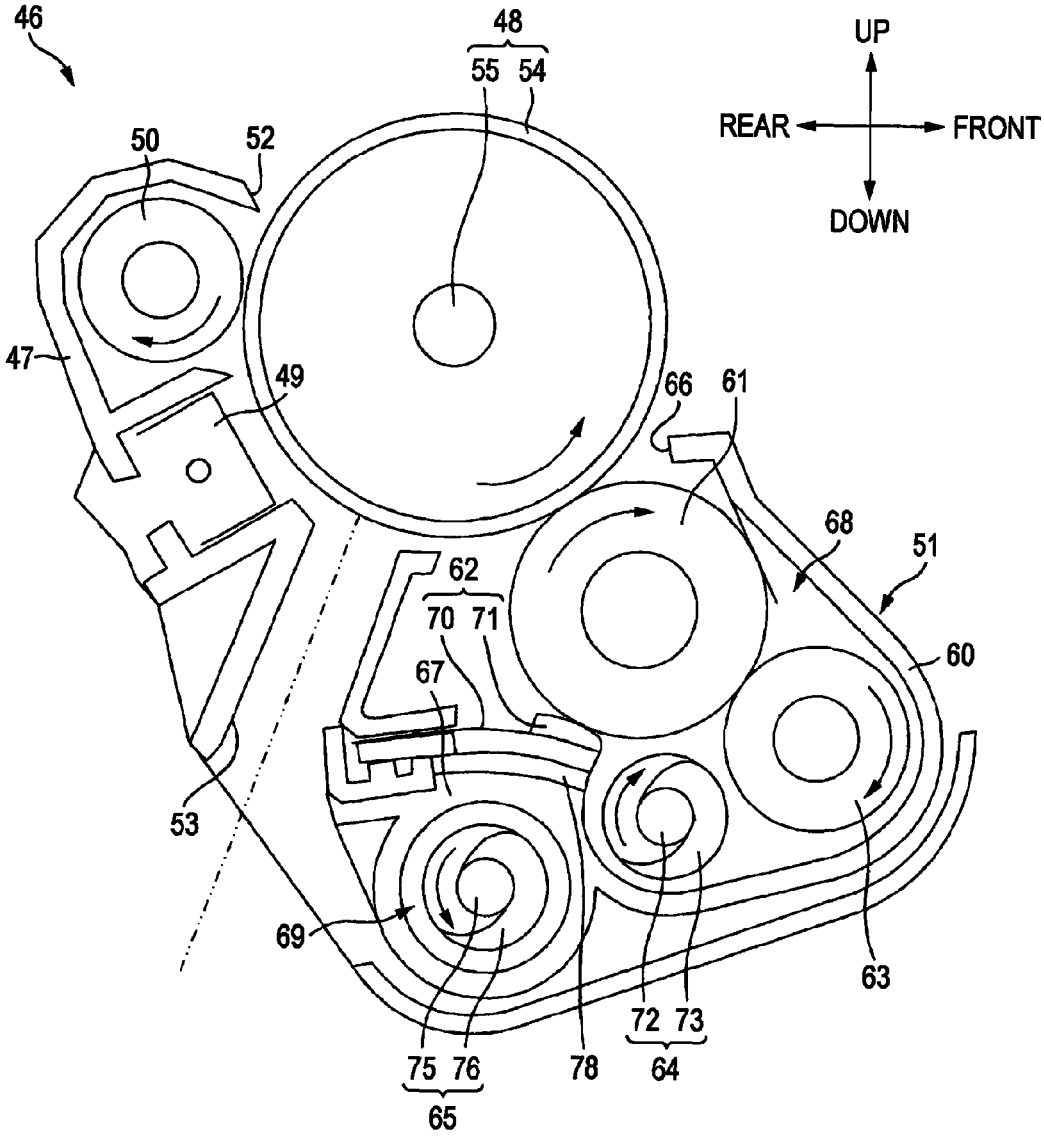
FIG. 2 is an enlarged side sectional view illustrating a part of the image forming apparatus of FIG. 1.
Figure 3:
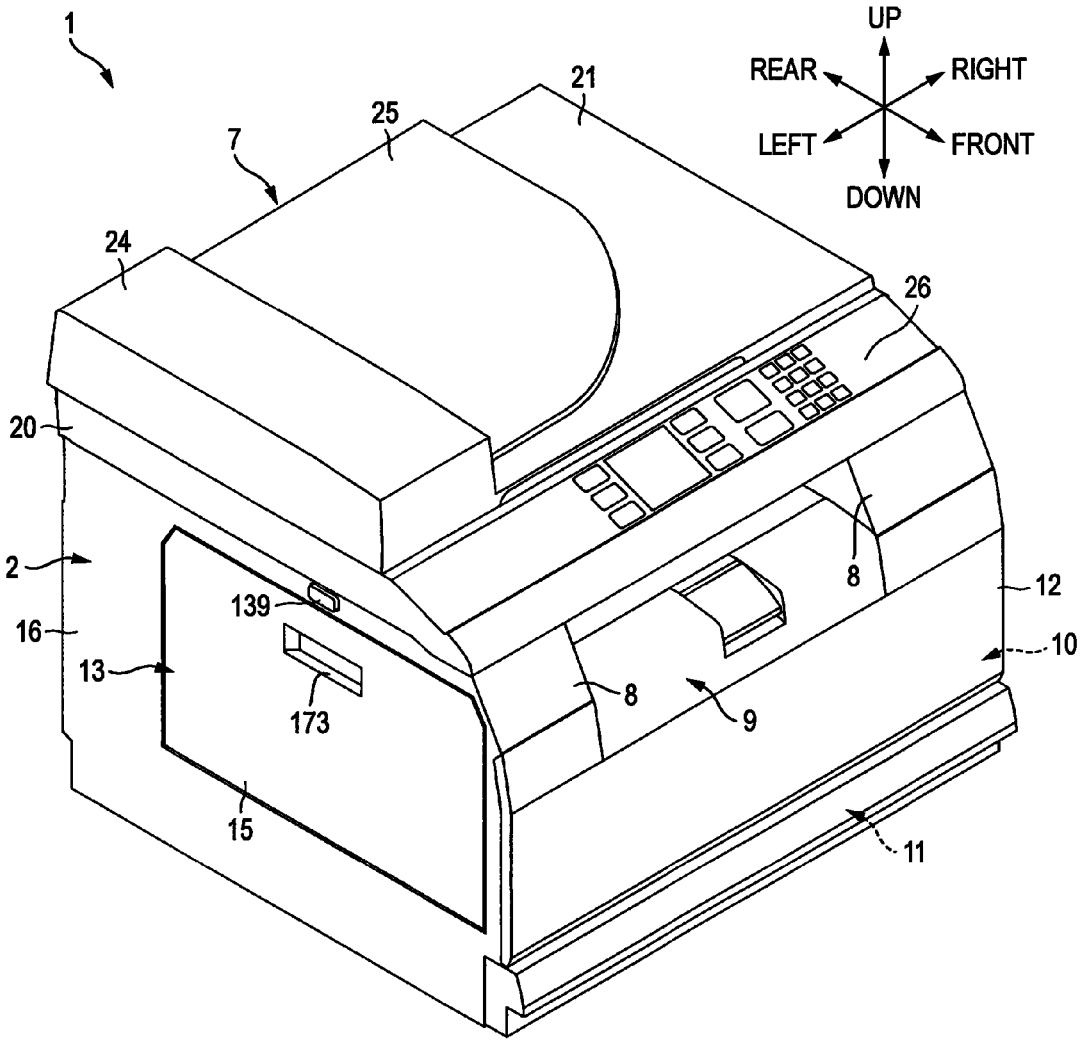
FIG. 3 is a left perspective view of the image forming apparatus of FIG. 1 showing a holder frame in a reception position.
Figure 4:
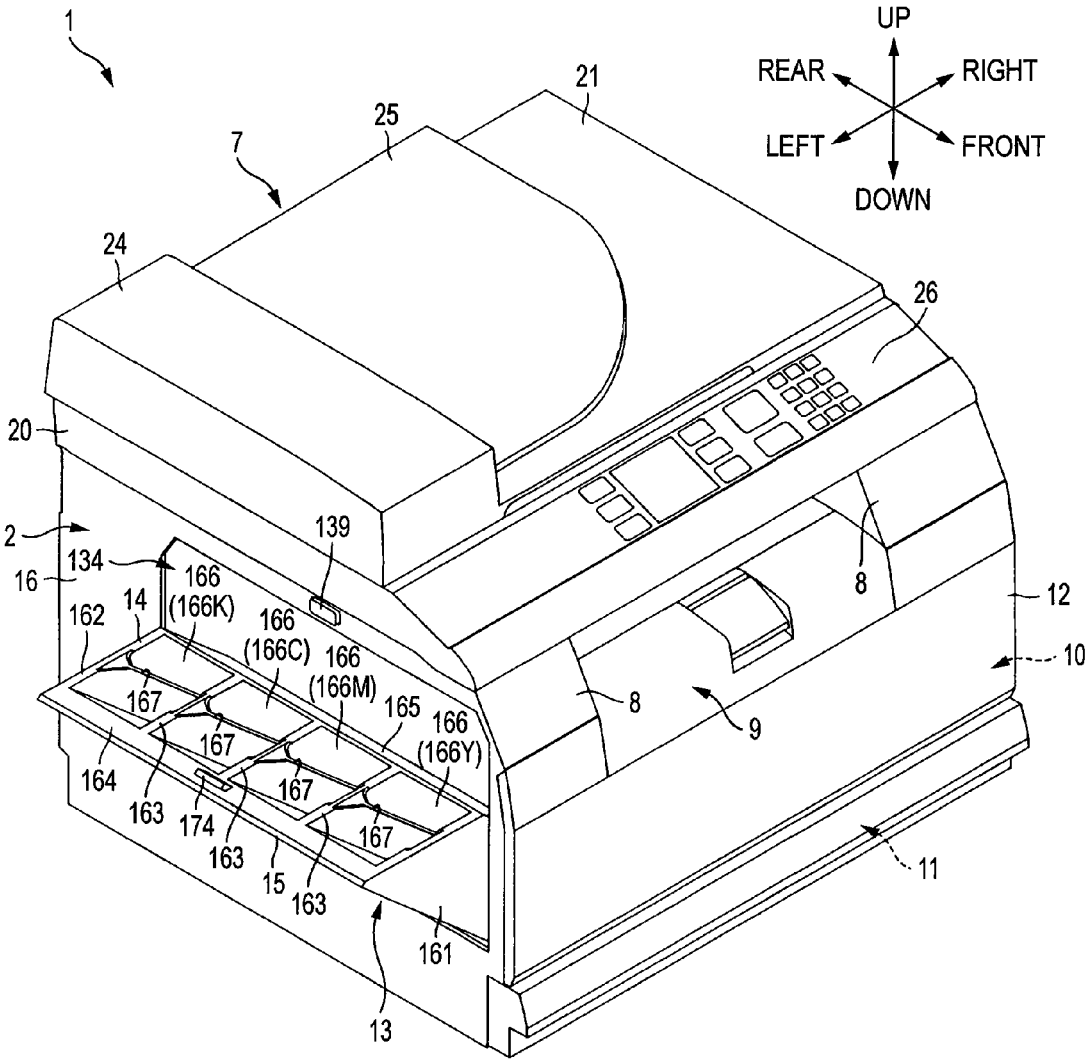
FIG. 4 is a left perspective view of the image forming apparatus of FIG. 1 showing a holder frame in an exposure position.
Figure 5:
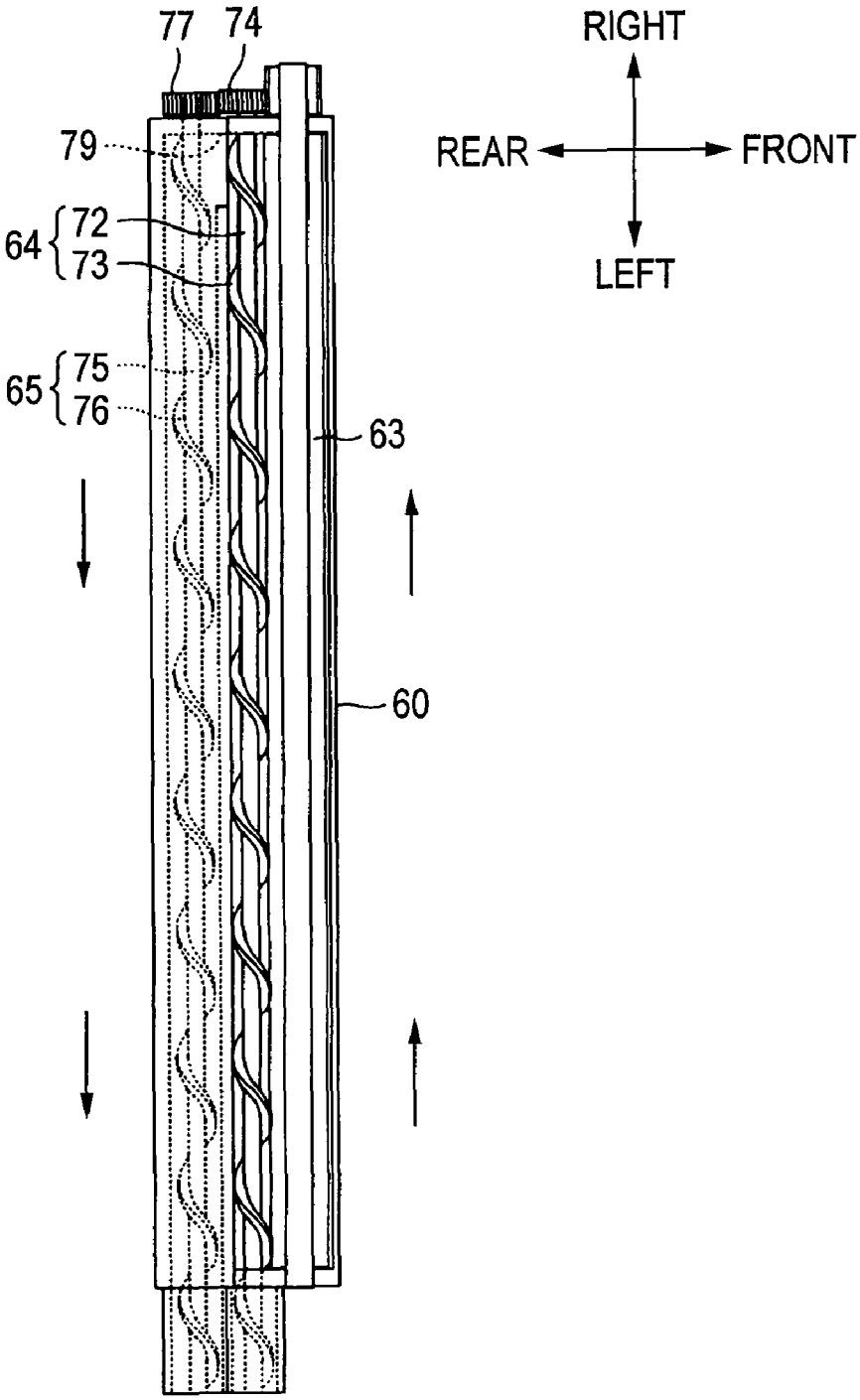
FIG. 5 is a top sectional view of a developing device of the image forming apparatus of FIG. 1 according to an exemplary embodiment of the present invention.

FIG. 1 is a side sectional view illustrating an example of an image forming apparatus according to an exemplary embodiment of the invention. FIG. 1 shows a color laser printer as an example of the image forming apparatus. However, the present inventive concept is not limited to a color laser printer and is applicable to other types of image forming apparatuses. FIG. 2 is an enlarge side sectional view illustrating a part of the image forming apparatus of FIG. 1. FIG. 3 is a left perspective view of the image forming apparatus of FIG. 1 in which a holder frame is in a reception position. FIG. 4 is a left perspective view of the image forming apparatus of FIG. 1 in which the holder frame is in an exposure position. FIG. 5 is a top sectional view of a developing device, according to an exemplary embodiment of the present invention, of the image forming apparatus of FIG. 1.

As shown in FIG. 1, the color laser printer 1 is a horizontal, tandem-type color laser printer in which a plurality of process units 46 are arranged in parallel in the horizontal direction.

As shown in FIG. 1, the color laser printer 1 is configured as a multi function device, which includes a main casing 2 as an example of the main body and a flat-bed (FB) unit 7 that is disposed above the main casing 2, for reading image information of a document.

The color laser printer 1 includes, within the main casing 2, a sheet feeding portion 4 for feeding a sheet 3, an image forming portion 5 for forming images on the fed sheet 3, and a sheet discharging portion 6 for discharging the sheet 3 having images formed thereon.

In the following description, the right side of FIG. 1 will be referred to as a front side (front surface side), and the left side of FIG. 1 will be referred to as a rear side (rear surface side). In addition, the front side in the thickness direction of the sheet in FIG. 1 will be referred to as a left side, and the rear side in the thickness direction of the sheet in FIG. 1 will be referred to as a right side. Incidentally, the left-right direction is the same as the width direction.

The process unit 46 and the toner cartridge 101 can be attached to and detached from a main casing 2. The directions of the process unit 46 and the toner cartridge 101 will be described based on the directions in a state in which they are attached to the main casing 2.

(1) Main Casing

As shown in FIG. 3, the main casing 2 is formed in a box-like shape. On a top wall of the main casing 2, a connecting portion 8 is provided substantially having a U shape in plan view. The connecting portion 8 is disposed at both ends and the rear end of the top wall of the main casing 2 so that the front portion thereof is open. The FB unit 7 is provided on the connecting portion 8.

A space surrounded by the top surface of the main casing 2, the connecting portion 8, and the bottom surface of the FB unit 7 is configured as an in-chassis sheet discharging portion 9 in which the sheet 3 is discharged.

Within the main casing 2, as shown in FIG. 1, a process receiving portion 10 is provided in which a process portion 38 is disposed.

On a front wall of the main casing 2 opposed to the process receiving portion 10, a front cover 12 is provided for opening and closing the process receiving portion 10. The lower end of the front cover 12 is pivotably provided to the main casing 2 via a hinge (not shown). When the front cover 12 is closed, the process receiving portion 10 closes. When the front cover 12 is open, the process receiving portion 10 opens as shown by an imaginary line in FIG. 1, thus allowing a drawer 45 that receives a plurality of process units 46 to be attached or detached.

As shown in FIGS. 3 and 4, a cartridge holder 13 is provided in a left side wall 16 of the main casing 2 opposed to the process receiving portion 10.

The cartridge holder 13 includes a holder frame 14 in which a plurality of toner cartridges 101 (see FIGS. 10 and 11) are detachably received and a side cover 15 that covers the left side of the holder frame 14. In this exemplary embodiment, a number of the toner cartridges 101 is four.

The lower end of the holder frame 14 is rotatably supported by the main casing 2. Accordingly, the holder frame 14 pivots in the left-right direction between a reception position (see FIG. 3) at which the toner cartridge 101 is received in the main casing 2 and an exposure position (see FIG. 4) at which the toner cartridge 101 is exposed from the left side of the main casing 2.

Within the main casing 2, as shown in FIG. 1, a tray receiving portion 11 that receives a sheet feeding tray 30 is provided below the process receiving portion 10. A front wall of the main casing 2 opposed to the tray receiving portion 11 is open.

(2) Flat-Bed (FB) Unit

As shown in FIG. 3, the FB unit 7 includes a document platen 20 and a document pressing cover 21 that is supported by the document platen 20 in an openable manner.

The document platen 20 has a rectangular, thick plate-like shape in plan view. The document platen 20 is supported by the connecting portion 8, and as shown in FIG. 1, a glass surface 22 on which a document is placed is buried in the top surface. In the document plate 20, a CCD sensor 23 for reading a document and a scan drive motor (not shown) for scanning the document with the CCD sensor 23 opposed to the glass surface 22 are provided.

As shown in FIG. 3, the document pressing cover 21 has a rectangular thin plate-like shape in plan view. The rear end is pivotably supported by the rear end of the document platen 20 via a hinge (not shown). The document pressing cover 21 is provided with an automatic document feeder (ADF) 24 for automatically reading a document at the left end of an upper portion thereof. A standby document tray 25 that extends rightward is provided in the ADF 24.

In the FB unit 7, an operation panel 26 having operation keys and a light emitting diode (LED) display portion is buried in an area located closer to the front end than the glass surface 22 of the document platen 20.

In the FB unit 7, during manual document reading operations, the front end of the document pressing cover 21 is first moved upward to place a document on the glass surface 22. Thereafter, the front end of the document pressing cover 21 is moved downward and the operation keys on the operation panel 26 are operated. Then, the CCD sensor 23 is driven by the scan drive motor and scans the document placed on the glass surface 22 in a direction from the left side to the right side in an opposing relationship with the document. Accordingly, image information of the document is read.

During automatic document reading operations by the ADF 24, when a document is set on the standby document tray 25, a document detecting sensor (not shown) detects the setting of document and the CCD sensor 23 is fixed at an automatic document reading position (not shown). Thereafter, when the operation keys are operated on the operation panel 26, the ADF 24 is driven and the document is moved leftward and is inserted into the ADF 24. The image information of the document is read by the CCD sensor 23 in a state that the document is opposed to the CCD sensor 23. Thereafter, the document is conveyed rightward from the ADF 24 and discharged onto the upper surface of the document pressing cover 21.

The image forming portion 5 (see FIG. 1) creates image data based on the image information of the document read by the CCD sensor 23 and forms images on the sheet 3, which will be described later.

(3) Sheet Feeding Portion

As shown in FIG. 1, the sheet feeding portion 4 is provided below the main casing 2. The sheet feeding portion 4 includes a sheet feeding tray 30 for receiving the sheet 3, a feed roller 31 provided above the rear end of the sheet feeding tray 30, and a supply roller 32 and a separation pad 33 that are provided at the rear side of the feed roller 31 in an opposing relationship with each other. The sheet feeding portion 4 also includes two auxiliary rollers 34 disposed above the separation pad 33 in an opposing relationship with the separation roller 32, a sheet feeding path 35 that extends slightly upward from the opposing portion of the separation roller 32 and the upper one of the auxiliary rollers 34, and a pair of conveying rollers 36 provided in the midway of the sheet feeding path 35.

The sheet feeding tray 30 is attached to and detached from the tray receiving portion 11 of the main casing 2 in a manner slidable in a direction from the front side to the rear side. When the sheet feeding tray 30 is received in the tray receiving portion 11, an open port in the front wall of the main casing 2 opposed to the tray receiving portion 11 is closed by the front end of the sheet feeding tray 30.

Within the sheet feeding tray 30, the sheet 3 is stacked, and the uppermost sheet 3 is supplied to the opposing portion of the separation roller 32 and the separation pad 33 with the rotation of the feed roller 31 and is processed on a one-by-one basis. Thereafter, the sheet 3 is fed from the separation roller 32 to the sheet feeding path 35 while being guided by the auxiliary rollers 34. Thereafter, the sheet 3 is conveyed to the conveying roller 36 and conveyed to a secondary transfer position (described later) between a secondary transfer roller 120 and an intermediate transfer belt 118.

(4) Image Forming Portion

The image forming portion 5 includes a scanner unit 37, a process portion 38, a transfer portion 40, and a fixing portion 41.

(4-1) Scanner Unit

The scanner unit 37 is disposed between the process receiving portion 10 and the tray receiving portion 11 in the main casing 2. Within the scanner unit 37, optical members including a light source (not shown), a polygon mirror 42, and a reflective mirror 43 are disposed.

Laser beams emitted from the light source, based on the image data, are deflected and scanned by the polygon mirror 42 and reflected from the reflective mirror 43, and thereafter, as shown by the chained line, are irradiated onto the surface of a photosensitive drum 48 (described later) as an example of the photosensitive member of each of the process units 46.

(4-2) Process Portion

The process portion 38 includes the drawer 45 and a plurality of process units 46 received in the drawer 45. In this exemplary embodiment, the process portion 38 includes four process units 46.

The four process units 46 are attached to the drawer 45 in a separately detachable manner. The drawer 45 is attached to and detached from the process receiving portion 10 by the opening of the front cover 12 in a manner slidable in a direction from the front side to the rear side, as shown by the imaginary line. Thus, a plurality of the process units 46 can be attached to and detached from the process receiving portion 10 in a bundle.

The process units 46 are provided to correspond to toners of each color.

That is, the process units 46 are composed of four units: a yellow process unit 46Y, a magenta process unit 46M, a cyan process unit 46C, and a black process unit 46K. These four process units 46 are arranged in parallel in this order with gaps therebetween in a direction from the front area to the rear area.

When the front cover 12 is opened to draw the drawer 45 out from the process receiving portion 10, the process units 46 are exposed from the main casing 2. At this time, by separately attaching or detaching the process units 46 to or from the drawer 45, it is possible to replace each of the process units 46.

(a) Process Unit

As shown in FIG. 2, each of the process units 46 includes a process casing 47 and includes, within the process casing 47, a photosensitive drum 48, a scorotron charger 49, a cleaning roller 50, and a developing unit 51 as an example of the developing device.

The process casing 47 is formed in a substantially rectangular, box-like shape in sectional view, extending from the lower front side to the upper rear side. A transfer opening 52 is formed in the upper portion of the process casing 47, and an input path 53 opposed to the transfer opening 52 is formed in the lower portion of the process casing 47.

The photosensitive drum 48 includes a drum body 54 and a drum shaft 55. The drum body 54 is formed in a hollow cylindrical shape, and the outermost layer is formed of a positively charged photosensitive layer such as polycarbonate. The drum shaft 55 is provided at the center of the rotation shaft of the drum body 54 and extends in the axial direction of the drum body 54. As shown in FIG. 1, in the exemplary embodiment, four photosensitive drums 48 are disposed in parallel, and a parallel direction of axes of the photosensitive drums 48 is substantially parallel to a rotation axis of the cartridge holder 13.

The drum shaft 55 is non-rotatably supported by both side walls of the process casing 47 that are disposed opposite each other with a gap in the width direction. The drum body 54 is rotatable about the drum shaft 55 with its upper half portion exposed upward from the transfer opening 52. The drum body 54 is grounded and during image forming operations, rotates in the counter-clockwise direction when seen from the left side by a driving force of a motor (not shown) provided in the main casing 2.

The scorotron charger 49 is supported by the rear wall of the process casing 47 above the input path 53 and is disposed at the lower rear side of the photosensitive drum 48 in an opposing relationship with the photosensitive drum 48 with a gap therebetween. The scorotron charger 49 is a positively charging scorotron charger which, during image forming operations, is applied with a high voltage from a high-voltage substrate (not shown) provided in the main casing 2 to generate a corona discharge.

The cleaning roller 50 is supported by the rear wall of the process casing 47 above the scorotron charger 49 and is disposed at the rear side of the photosensitive drum 48 in an opposing contact relationship with the photosensitive drum 48. During image forming operations, the cleaning roller 50 rotates in the clockwise direction, when seen from the left side, by a driving force of the motor, and is applied with a cleaning bias from the high-voltage substrate.

(b) Developing Unit

As shown in FIG. 1, four developing units 51 are provided to correspond to four photosensitive drums 48. As shown in FIG. 2, each of the developing units 51 includes a developing casing 60 and includes, within the developing casing 60, a developing roller 61, a thickness regulating blade 62, a supply roller 63, a conveying auger 64, and a return auger 65.

(b-1) Developing Casing

The developing casing 60 is formed in a substantially trapezoidal, box-like shape in sectional view, with its width decreasing in a direction from the lower front side to the upper rear side. A developing opening 66 that is open upward is formed in the upper portion of the developing casing 60.

On the lower portion of the developing casing 60, a partition wall 67 is formed that covers a corner portion at the lower rear side in the width direction. The inner space of the developing casing 60 is vertically partitioned by the partition wall 67 into an upper space that forms a developing chamber 68 and a lower space that forms a toner return chamber 69. The developing chamber 68 and the toner return chamber 69 communicate with each other via a communication port 79 (see FIG. 5) formed in the right end of the partition wall 67.

(b-2) Developing Roller

The developing roller 61 is disposed below the developing opening 66 in an opposing contact relationship with the photosensitive drum 48 via the developing opening 66. The developing roller 61 is rotatably supported by the developing casing 60. During image forming operations, the developing roller 61 rotates in the clockwise direction when seen from the left side by the driving force of the motor and is applied with a developing bias from a high-voltage substrate. In the exemplary embodiment, an axial direction of the developing roller 61 corresponds to a longitudinal direction of the developer carrying members of claims.

(b-3) Thickness Regulating Blade

The thickness regulating blade 62 is disposed below the developing roller 61 in the developing chamber 68. The thickness regulating blade 62 includes a blade body 70 formed of a spring steel plate and a pressure-contact portion 71 formed of insulating silicon rubber. The rear end of the blade body 70 is supported by the developing casing 60, and the front end of the blade body 70 is supported by a pressure-contact portion 71. The pressure-contact portion 71 pressure-contacts the surface of the developing roller 61 from the down side by the elastic force of the blade body 70.

A sponge seal 78 is provided between the partition wall 67 and the blade body 70. The sponge seal 78 is stacked on the partition wall 67 along the partition wall 67. The blade body 70 is disposed on the sponge seal 78.

(b-4) Supply Roller

The supply roller 63 is disposed at the lower front side of the developing roller 61 and at the upper front side of the conveying auger 64, in the inner front portion of the developing chamber 68. The supply roller 63 is rotatably supported by the developing casing 60. The supply roller 63 is in mutual pressure contact with the developing roller 61. During image forming operations, the supply roller 63 rotates in the clockwise direction when seen from the left side by the driving fore of the motor.

(b-5) Conveying Auger

The conveying auger 64 is disposed below the developing roller 61 and at the lower rear side of the supply roller 63 within the developing chamber 68. The conveying auger 64 is disposed at a distance from the developing roller 61 and the supply roller 63.

As shown in FIG. 5, the conveying auger 64 includes a conveying auger shaft 72 and a conveying screw 73. The conveying auger shaft 72 is rotatably supported by the developing casing 60. The conveying screw 73 is continuously provided in the axial direction around the conveying auger shaft 72. The conveying screw 73 is formed in a spiral shape so that toner can be conveyed in the width direction from the left side to the right side.

The conveying auger 64 is provided to protrude from the left side in the width direction of the developing casing 60 toward the outside (the left side). During image forming operations, the driving force of the motor is transmitted to a conveying auger gear 74 connected at the right end of the conveying auger shaft 72, and the conveying auger 64 rotates in the clockwise direction when seen from the left side.

(b-6) Return Auger

As shown in FIG. 2, the return auger 65 is received in the toner return chamber 69 below the thickness regulating blade 62. The return auger 65 is disposed at the lower rear side of the conveying auger 64 in an opposing relationship with the conveying auger 64 with the partition wall 67 disposed therebetween.

As shown in FIG. 5, the return auger 65 includes a return auger shaft 75 and a return screw 76. The return auger shaft 75 is rotatably supported by the developing casing 60. The return screw 76 is continuously provided in the axial direction around the return auger shaft 75. The return screw 76 is formed in a spiral shape so that toner can be conveyed in a direction from the right side to the left side.

The return auger 65 is provided to protrude from the left side of the developing casing 60 toward the left side. During image forming operations, the driving force of the motor is transmitted to a return auger gear 77 connected at the right end of the return auger shaft 75, and the return auger 65 rotates in the counter-clockwise direction when seen from the left side.

(c) Toner Cartridge

Figure 10:
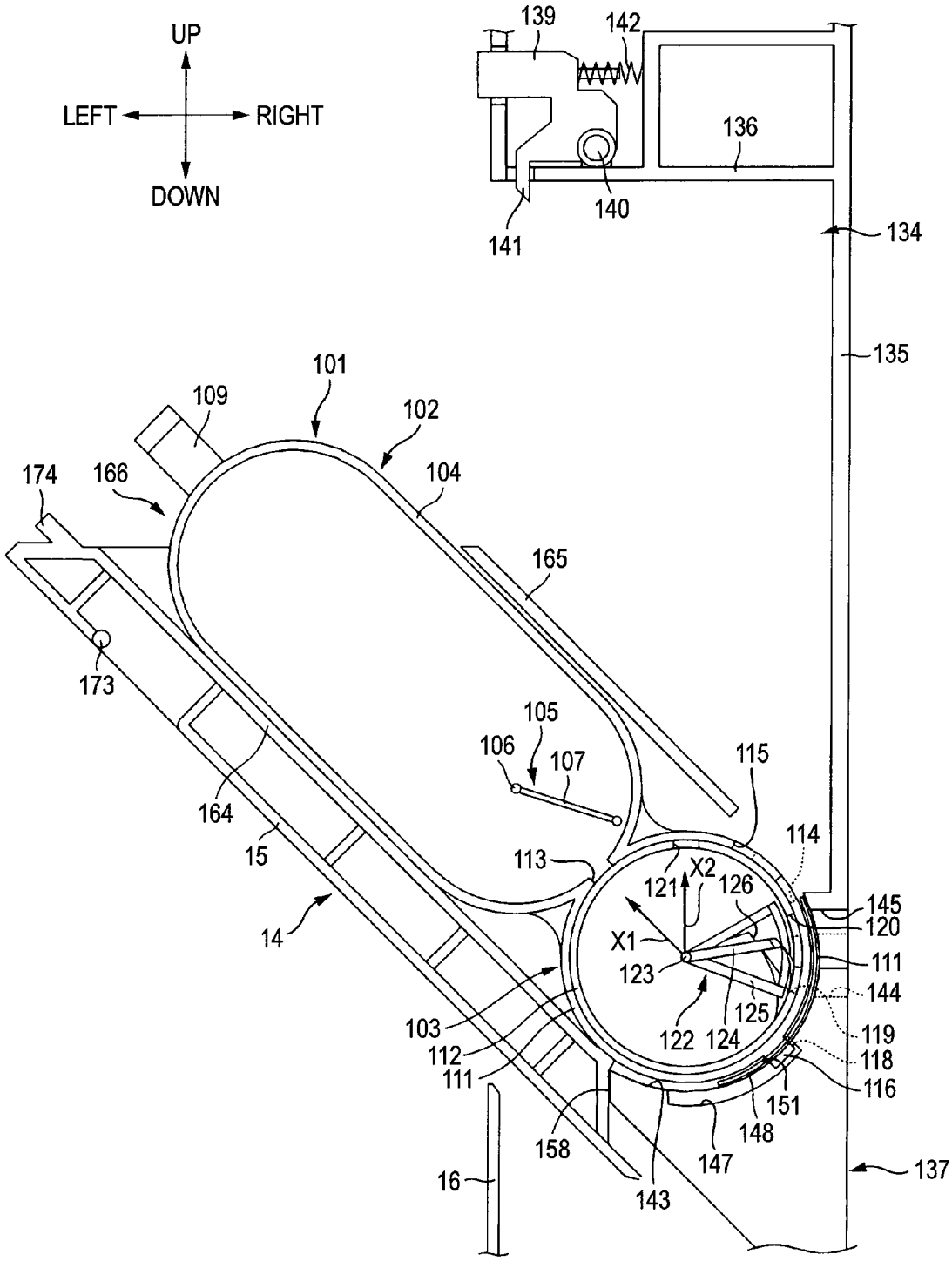
FIG. 10 is a front sectional view of the cartridge holder of FIG. 9 in which the toner cartridge is in an attachment state, and the holder frame is in an exposure position.
Figure 11:
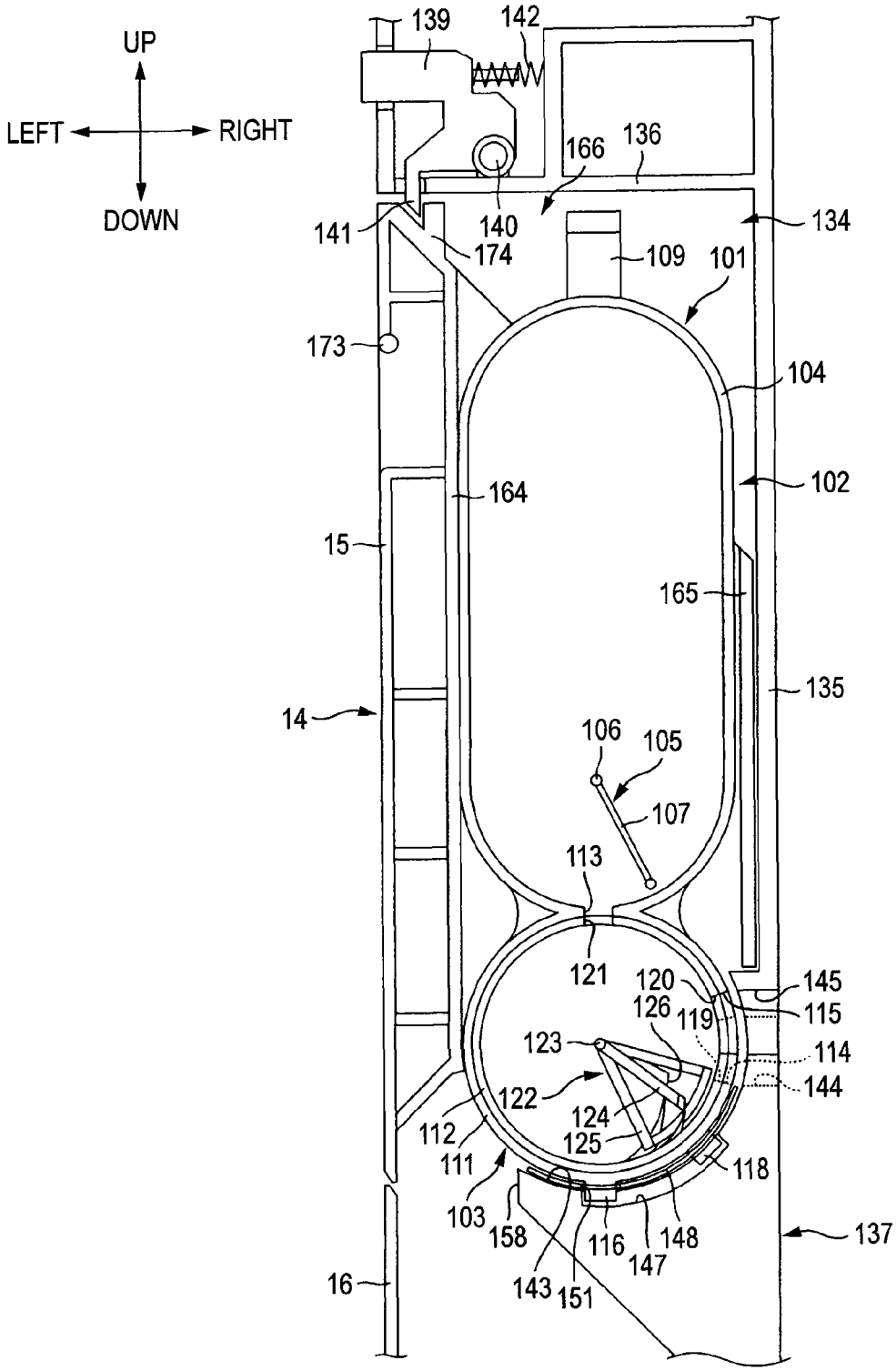
FIG. 11 is a front sectional view of the cartridge holder of FIG. 10 in which the toner cartridge is in an attachment state, and the holder frame is in a reception position.

A toner cartridge 101 is an example of the cartridge and is detachably attached to the developing casing 60 (see FIGS. 10 and 11). Four toner cartridges 101 are provided to correspond to four developing units 51. Each of the toner cartridges 101 is detachably received in the holder frame 14.

A nonmagnetic, mono-component, positively-charged toner corresponding to each color, an example of the developer, is stored in each of the toner cartridges 101.

The toner cartridge 101 is attached to and detached from the developing casing 60 from the left ends in the axial direction of the return auger 65 and the conveying auger 64, which will be described later.

(d) Developing Process in Process Unit

The toner stored in the toner cartridge 101 is supplied to the conveying auger 64. As shown in FIG. 5, the toner supplied to the conveying auger 64 is conveyed by the rotating conveying screw 73 from the left end to the right end within the developing chamber 68 along the axial direction of the conveying auger 64. The toner is supplied to the supply roller 63 while being conveyed, and the toner that was not supplied to the supply roller 63 is returned to the return auger 65 via the communication port 79 of the partition wall 67.

The toner returned to the return auger 65 is conveyed by the rotating return screw 76 from the right end to the left end within the developing chamber 68 along the axial direction of the return auger 65. Thereafter, the toner is returned to the toner cartridge 101. Thus, the toner circulates between the toner cartridge 101 and the developing casing 60.

As shown in FIG. 2, the toner supplied to the supply roller 63 is supplied to the developing roller 61 by the rotation of the supply roller 63. At this time, the toner is positively charged by friction while being passed between the supply roller 63 and the developing roller 61. Thereafter, the toner is moved between the pressure-contact portion 71 and the developing roller 61 with the rotation of the developing roller 61 and formed as a thin layer having a thickness. Accordingly, the toner is carried on the surface of the developing roller 61 as a thin layer.

On the other hand, the surface of the drum body 54 is uniformly positively charged by a corona discharge generated from the scorotron charger 49. The positively charged surface is exposed by laser beams emitted from the scanner unit 37 with the rotation of the drum body 54 and input via the input path 53. Accordingly, electrostatic latent images corresponding to the images to be formed on the sheet 3 are formed on the surface of the drum body 54.

When the drum body 54 rotates, the toner carried on the surface of the developing roller 61 is supplied to the electrostatic latent images formed on the surface of the drum body 54 when contacting the drum body 54 in an opposing relationship with the rotation of the developing roller 61. Thus, the electrostatic latent images on the drum body 54 are developed and toner images corresponding to each color are carried on the surface of the drum body 54.

(4-3) Transfer Unit

As shown in FIG. 1, the transfer unit 40 is disposed above the process receiving portion 10 so as to extend in the front-rear direction. The transfer unit 40 includes a driving roller 81, a driven roller 82, an intermediate transfer belt 83, a primary transfer roller 84, a secondary transfer roller 85, a relay path 86, and a cleaning unit 87.

The driving roller 81 is disposed at the upper rear side of the photosensitive drum 48 of the black process unit 46K. The driving roller 81 rotates in a direction (clockwise direction in the drawing) opposite to the rotation direction of the photosensitive drum 48 during image forming operations.

The driven roller 82 is disposed at the upper front side of the photosensitive drum 48 of the yellow process unit 46Y in an overlapping manner with the driving roller 81 in the front-rear direction. When the driving roller 81 rotates, the driven roller 82 is rotated in the same direction (clockwise direction in the drawing) as the rotation direction of the driving roller 81.

The intermediate transfer belt 83 is made of a conductive resin having conductive particles such as carbon scattered thereon and is formed in an endless belt shape. The intermediate transfer belt 83 is wound between the driving roller 81 and the driven roller 82.

Each of the photosensitive drums 48 is exposed upward from a transfer opening 52 (see, e.g., FIG. 2) and is disposed below the intermediate transfer belt 83. The outer surface of the intermediate transfer belt 83 is disposed in an opposing contact relationship with all the photosensitive drums 48.

The driven roller 82 is driven by the rotation of the driving roller 81, and the intermediate transfer belt 83 circulates in the clockwise direction in the drawing between the driving roller 81 and the driven roller 82.

The primary transfer roller 84 is disposed in the inner space of the wound intermediate transfer belt 83. The primary transfer roller 84 comprises a plurality of transfer rollers 84 each corresponding to one of the photosensitive drums 48 of the process units 46. Each of the primary transfer rollers 84 is disposed above the corresponding photosensitive drum 48 in an opposing relationship with the photosensitive drum 48 with the intermediate transfer belt 83 disposed therebetween.

During image forming operations, the primary transfer rollers 84 rotate in the same direction (clockwise direction in the drawing) as the circulation direction of the intermediate transfer belt 83 at a position (primary transfer position) at which the primary transfer rollers 84 contact the intermediate transfer belt 83). The primary transfer rollers 84 are applied with a primary transfer bias during image forming operations.

The secondary transfer roller 85 is disposed at the rear side of the driving roller 81 so that the intermediate transfer belt 83 is sandwiched between the driving roller 81 and the secondary transfer roller 85. During image forming operations, the secondary transfer roller 85 rotates in a direction (counter-clockwise direction in the drawing) opposite to the circulation direction of the intermediate transfer belt 83 at a position (secondary transfer position) at which the secondary transfer roller 85 contacts the intermediate transfer belt 83). The secondary transfer roller 85 is applied with a secondary transfer bias during image forming operations.

The relay path 86 is formed to extend slightly upward from the secondary transfer position toward the fixing portion 41.

The circulating intermediate transfer belt 83 sequentially passes through the contact positions (primary transfer position) of the photosensitive drums 48 and the process units 46 in the front-to-rear direction. Toner images carried on the photosensitive drums 48 corresponding to each color are sequentially transferred to the intermediate transfer belt 83 by the primary transfer bias applied to the primary transfer rollers 84 during a period in which the intermediate transfer belt 83 passes through the photosensitive drums 48. Accordingly, color images are formed on the intermediate transfer belt 83.

Specifically, yellow toner images carried on the surface of the photosensitive drum 48 of the yellow process unit 46Y are transferred to the intermediate transfer belt 83 and thereafter, magenta toner images carried on the surface of the photosensitive drum 48 of the magenta process unit 46M are overlapped and transferred to the intermediate transfer belt 83 having the yellow toner images formed thereon.

By repeating the same operations, cyan toner images carried on the surface of the photosensitive drum 48 of the cyan process unit 46C and black toner images carried on the surface of the photosensitive drum 48 of the black process unit 46K are overlapped and transferred to the intermediate transfer belt 83. Accordingly, color images are formed on the intermediate transfer belt 83.

The color images formed on the intermediate transfer belt 83 are entirely transferred by the secondary transfer bias applied to the secondary transfer roller 85, onto the sheet 3 conveyed from the sheet feeding portion 4 to the secondary transfer position during a period in which the intermediate transfer belt 83 passes through the contact position (secondary transfer position) with the secondary transfer roller 85. The sheet 3 having the color images transferred thereto is conveyed to the fixing portion 41 along the relay path 86.

The cleaning unit 87 is disposed above the intermediate transfer belt 83 and includes a primary cleaning roller 88, a secondary cleaning roller 89, a scraping blade 90, and a storing portion 91.

In the cleaning unit 87, the toner adhering onto the surface of the intermediate transfer belt 83 during the above-described transfer process is first transferred from the surface of the intermediate transfer belt 83 to the primary cleaning roller 88. Thereafter, the toner is transferred to the secondary cleaning roller 89. Then, the toner is scraped by the scraping blade 90 and falls off from the secondary cleaning roller 89 to be stored in the storing portion 91.

(4-4) Fixing Portion

The fixing portion 41 is disposed above the secondary transfer position, and includes a heating roller 93 and a pressing roller 94 disposed opposite the heating roller 93 and pressing the heating roller 93. In the fixing portion 41, the color images transferred onto the sheet 3 are thermally fixed onto the sheet 3 by heat and pressure during a period in which the sheet 3 is passed between the heating roller 93 and the pressing roller 94.

(5) Sheet Discharging Portion

The sheet discharging portion 6 includes a pair of conveying rollers 95, a sheet discharging path 96, a discharge roller 97, and a sheet discharging tray 98.

The pair of conveying rollers 95 are disposed at the upper front side of the fixing portion 41 in a mutually contacting relationship.

The sheet discharging path 96 is formed to extend forward from the contact position of the pair of conveying rollers 95.

The discharge roller 97 comprises three rollers in which two rollers are in contact with a remaining one roller. The discharge rollers 97 are disposed at the front side of the sheet discharging path 96 so that one of the rollers is exposed into the in-chassis sheet discharging portion 9.

The sheet discharging tray 98 is formed as the top wall of the main casing 2 in the in-chassis sheet discharging portion 9. The sheet discharging tray 98 is formed as a depression that gradually deepens from the front side to the rear side.

In the sheet discharging portion 6, the thermally fixed sheet 3 is conveyed by the conveying rollers 95 along the sheet discharging path 96 and is discharged onto the sheet discharging tray 98 by the discharge roller 97.

2. Toner Cartridge and Cartridge Holder

Figure 6:
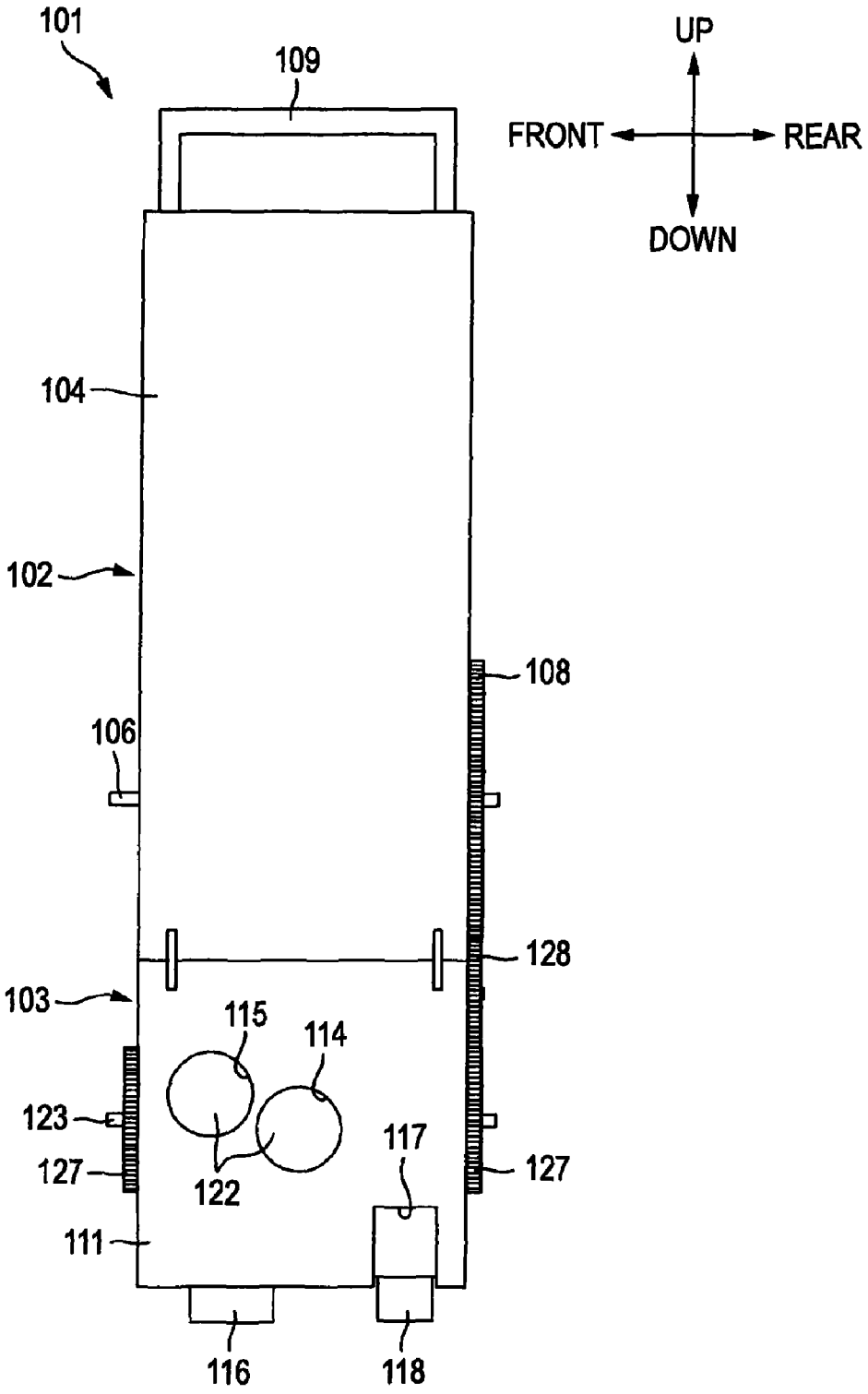
FIG. 6 is a right sectional view of a toner cartridge of the image forming apparatus of FIG. 1 according to an exemplary embodiment of the present invention.
Figure 7:
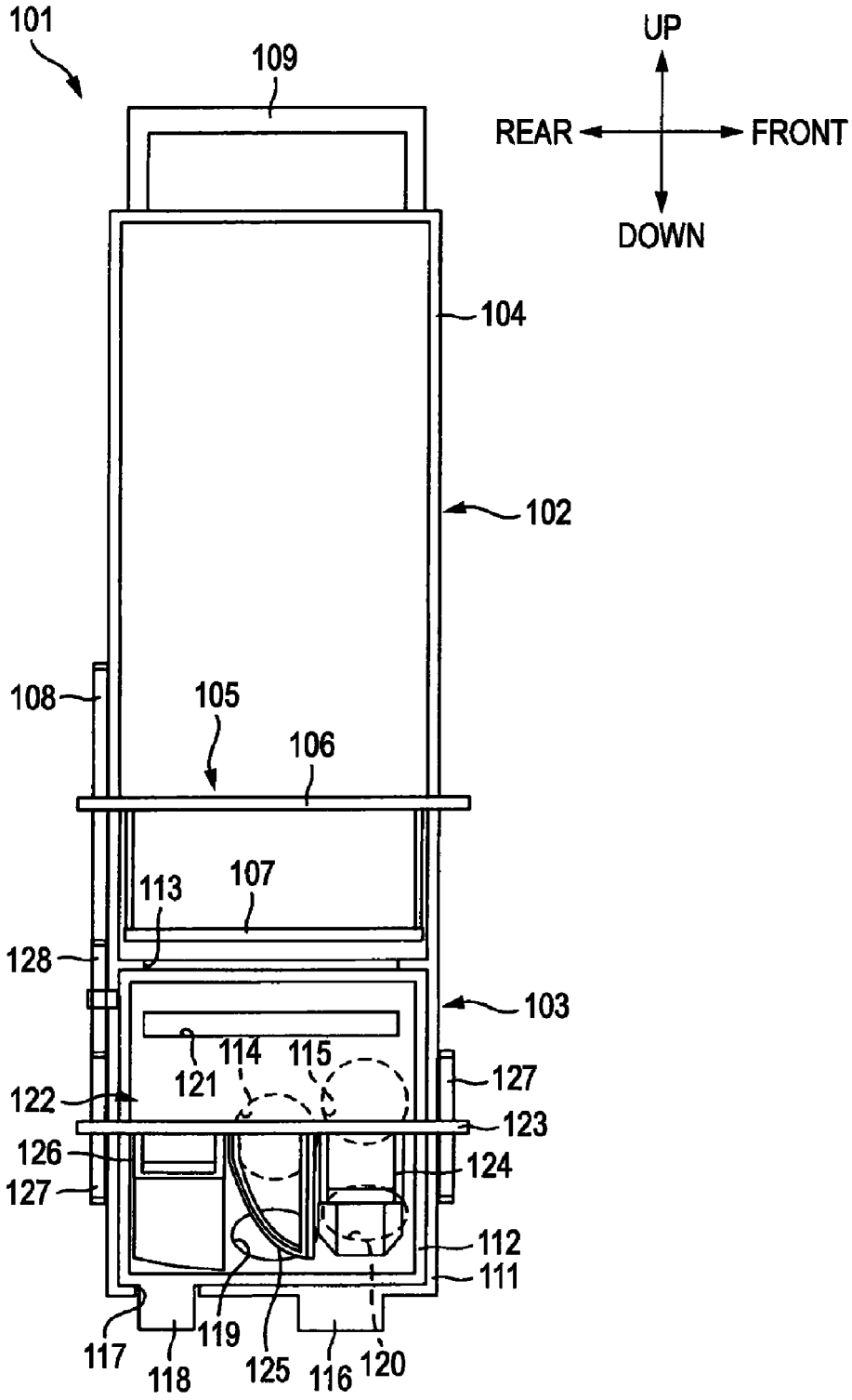
FIG. 7 is a left sectional view of the toner cartridge of FIG. 6.
Figure 8:
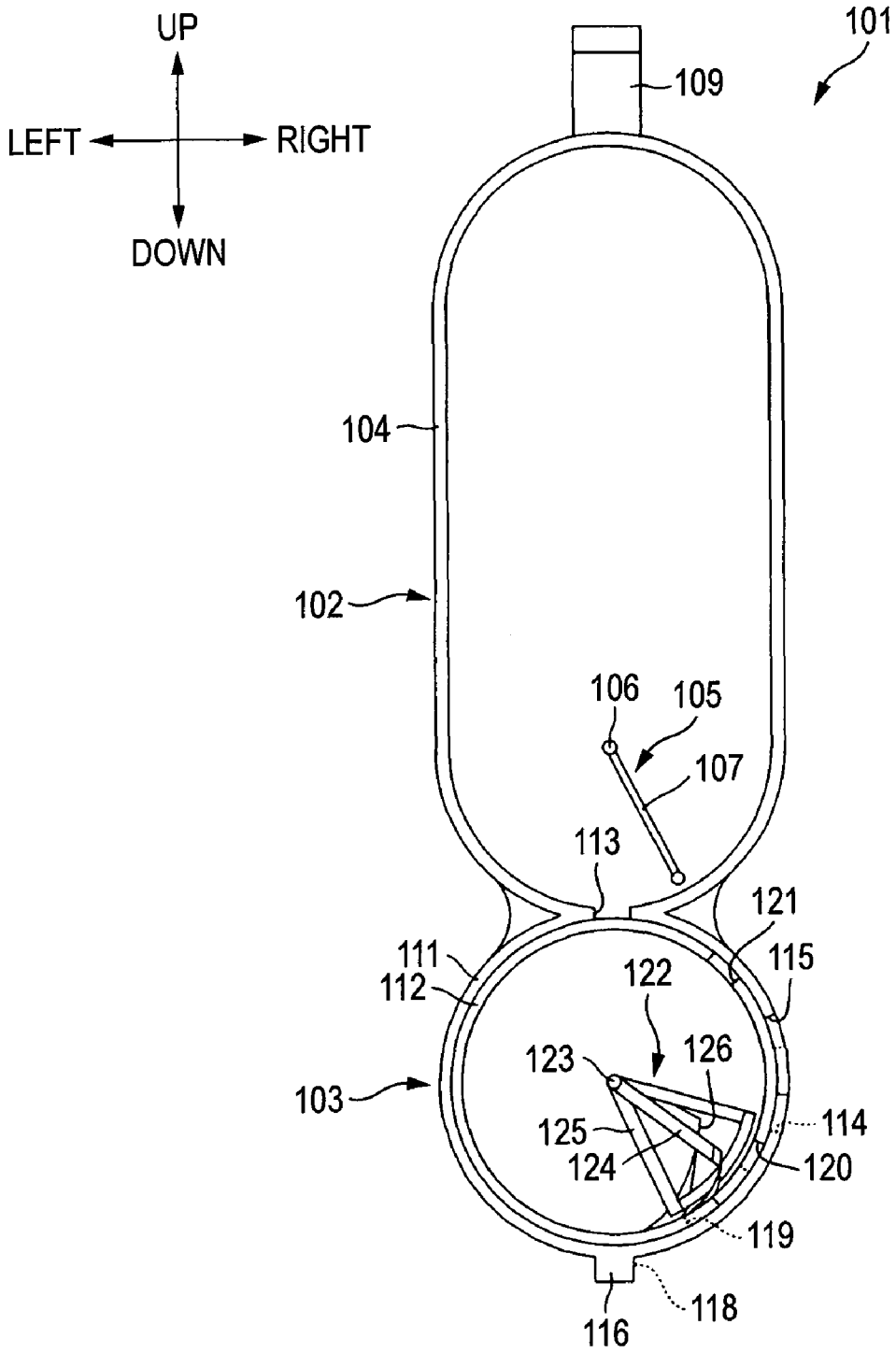
FIG. 8 is a front sectional view of the toner cartridge of FIG. 6.
Figure 9:
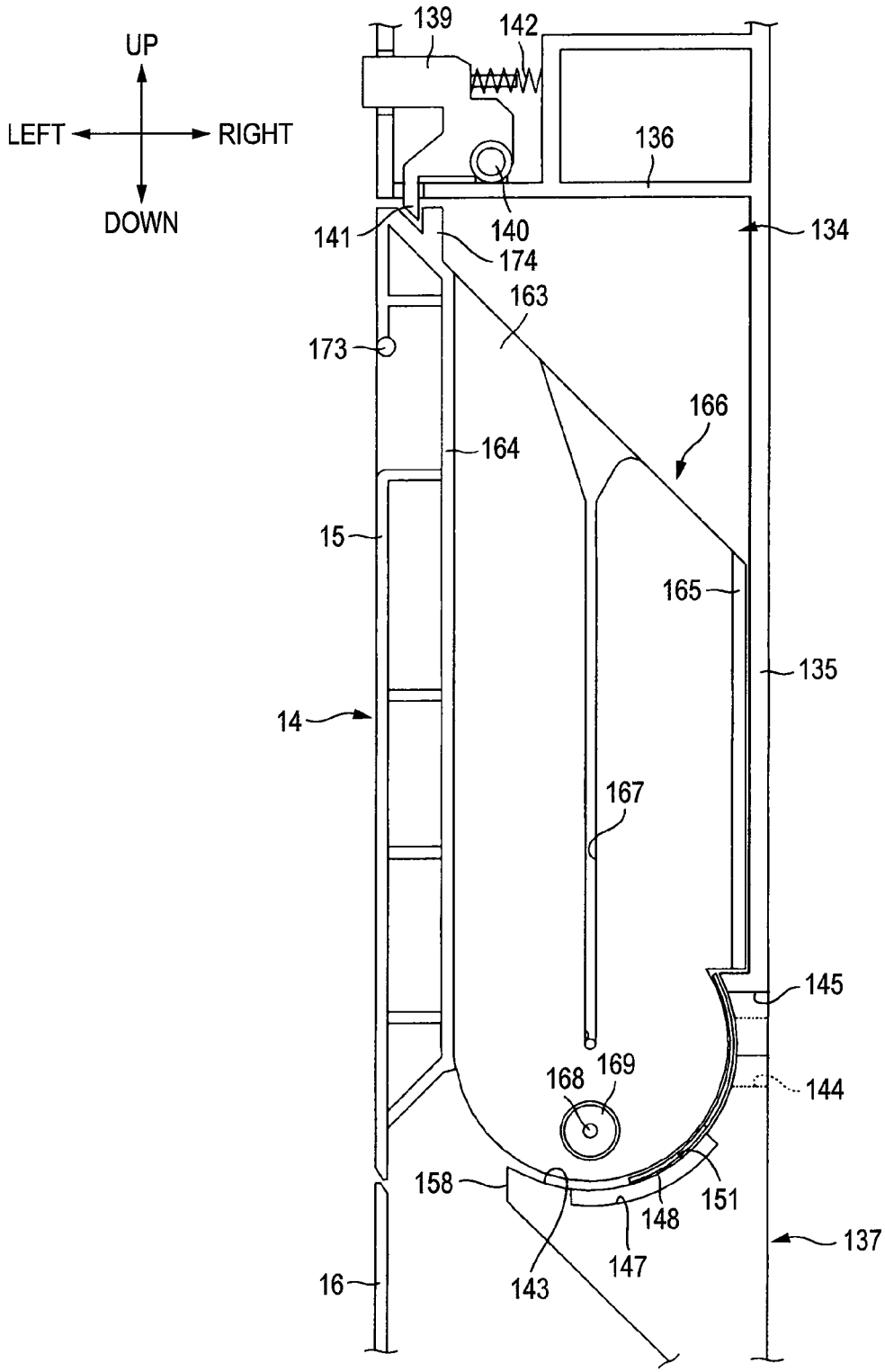
FIG. 9 is a front sectional view of a cartridge holder, according to an exemplary embodiment of the present invention, of the image forming apparatus of FIG. 1 in which the toner cartridge is in a detachment state, and the holder frame is in a reception position.
Figure 12:
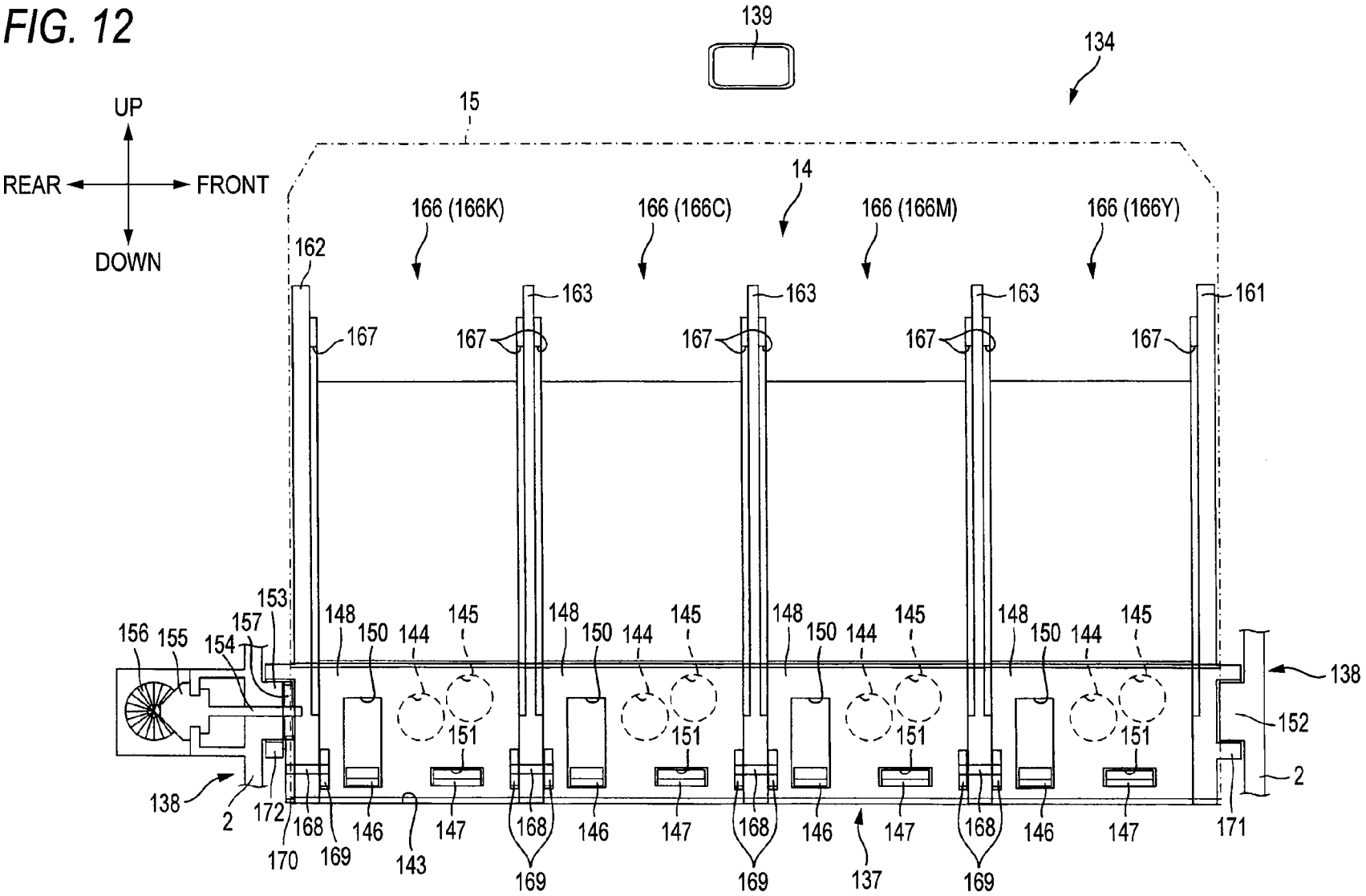
FIG. 12 is a front sectional view of the cartridge holder of FIG. 9 in which the toner cartridge is in a detachment state, and the holder frame is in a reception position.
Figure 13:
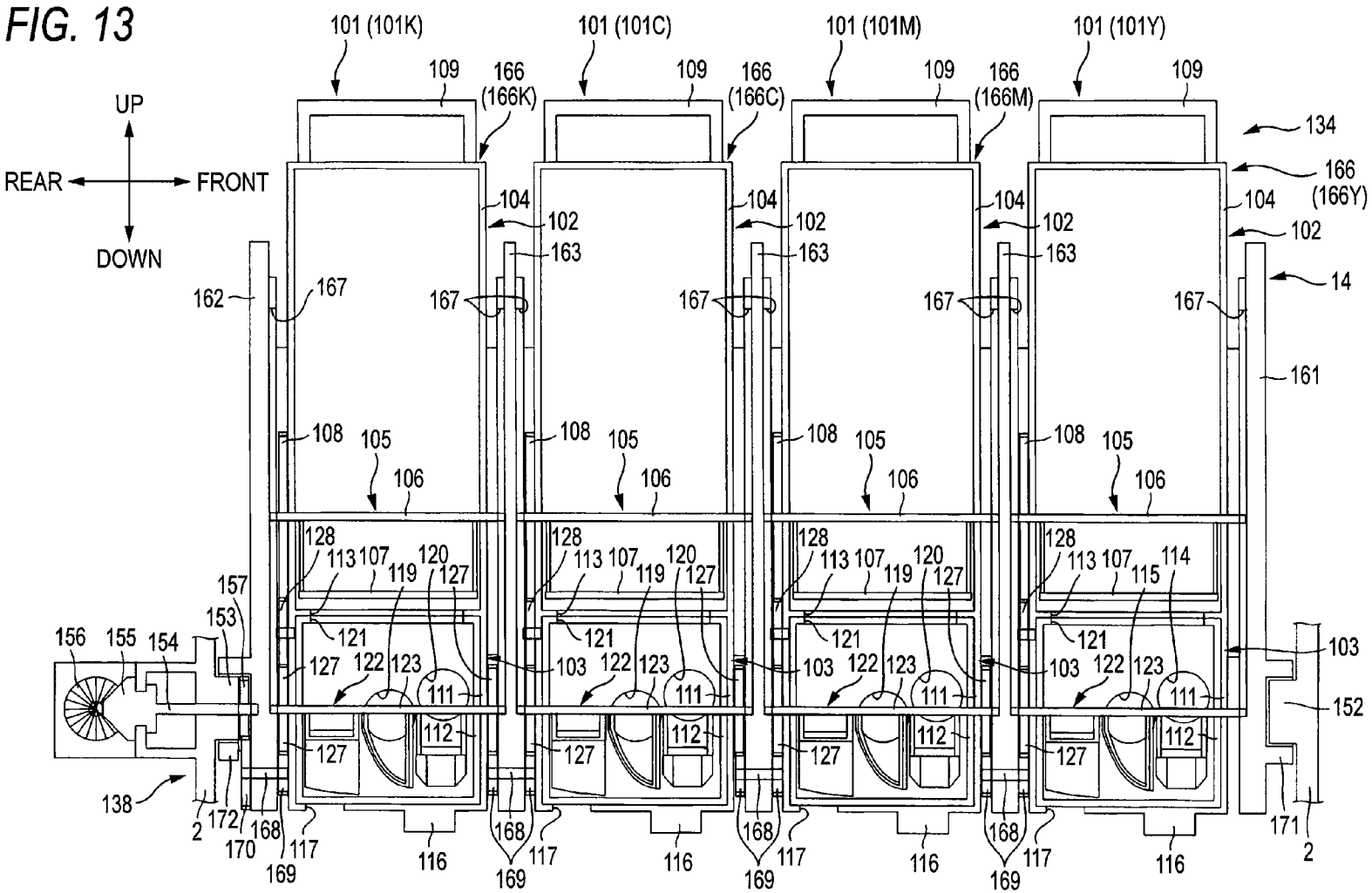
FIG. 13 is a left sectional view of the cartridge holder of FIG. 12 in which the toner cartridge is in an attachment state, and the holder frame is in a reception position.
Figure 14:
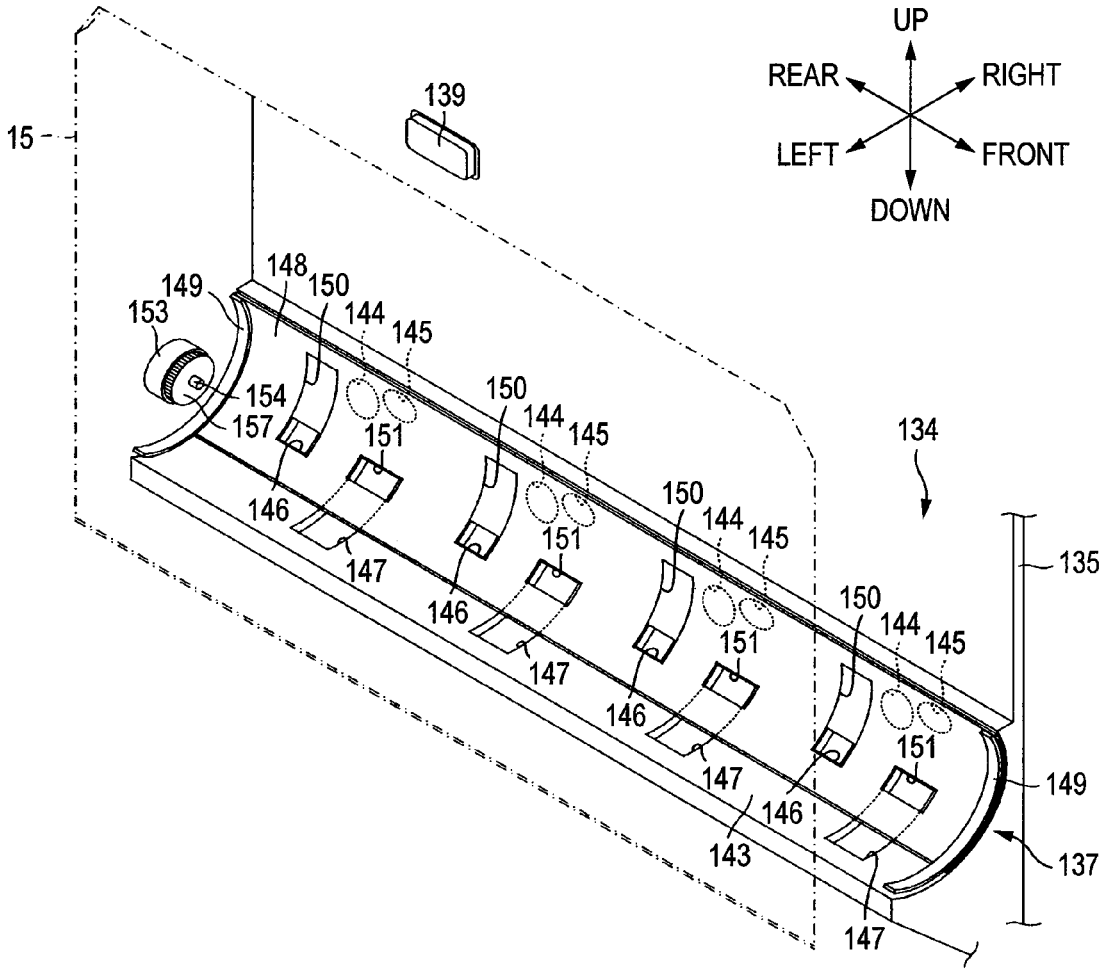
FIG. 14 is a partial left perspective view of the cartridge holder of FIG. 13 in which the holder frame is in an exposure position.
Figure 15:
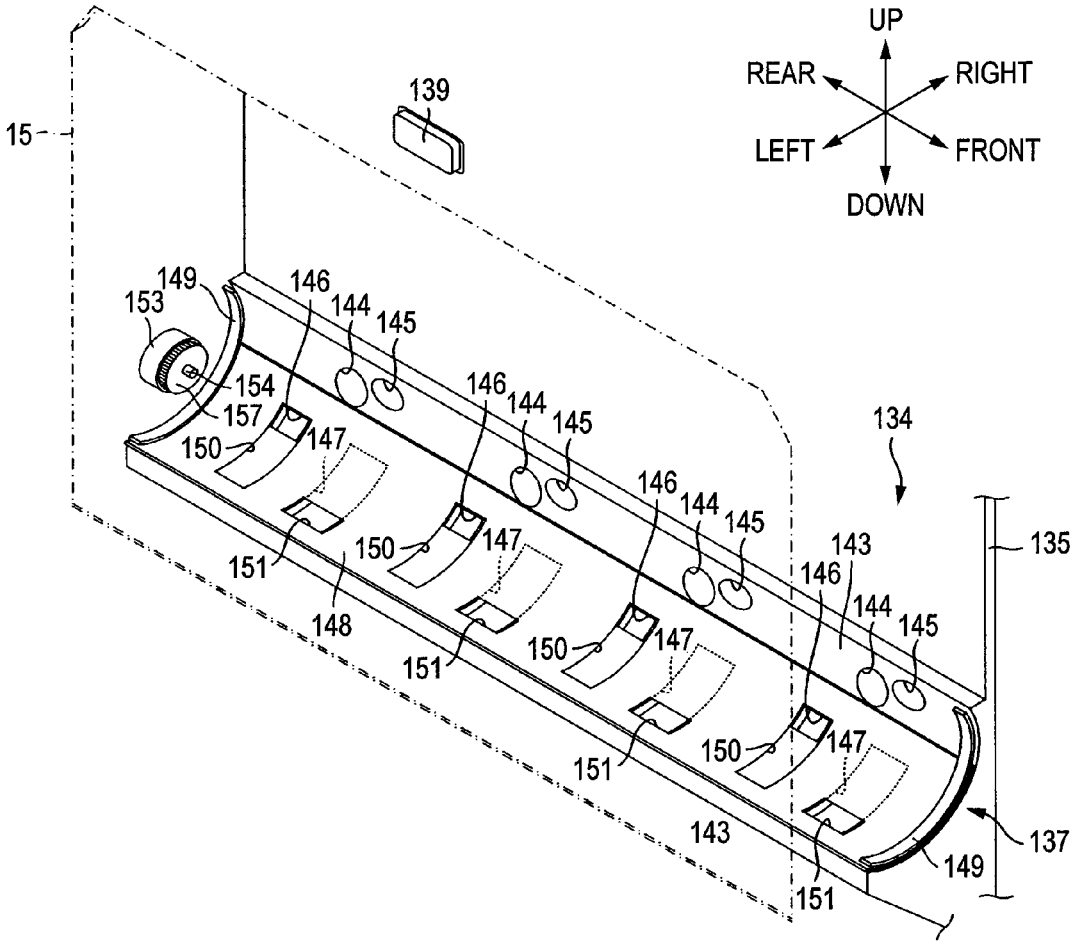
FIG. 15 is a partial left perspective view of the cartridge holder of FIG. 13 in which the holder frame is in a reception position.

FIG. 6 is a right sectional view of a toner cartridge of the image forming apparatus of FIG. 1 according to an exemplary embodiment of the present invention. FIG. 7 is a left sectional view of the toner cartridge of FIG. 6. FIG. 8 is a front sectional view of the toner cartridge of FIG. 6. FIG. 9 is a front sectional view of a cartridge holder, according to an exemplary embodiment of the present invention, of the image forming apparatus of FIG. 1 in which the toner cartridge is in a detachment state, and the holder frame is in a reception position. FIG. 10 is a front sectional view of the cartridge holder of FIG. 9 in which the toner cartridge is in an attachment state, and the holder frame is in an exposure position. FIG. 11 is a front sectional view of the cartridge holder of FIG. 10 in which the toner cartridge is in an attachment state, and the holder frame is in a reception position. FIG. 12 is a front sectional view of the cartridge holder of FIG. 9 in which the toner cartridge is in a detachment state, and the holder frame is in a reception position. In FIG. 12, a body-side return port 144 and a body-side return port 145 are closed by a shutter plate 148. This is because the holder frame 14 at the detachment state of the toner cartridge 101 is moved from an exposure position to an reception position. FIG. 13 is a left sectional view of the cartridge holder of FIG. 12 in which the toner cartridge is in an attachment state, and the holder frame is in a reception position. FIG. 14 is a partial left perspective view of the cartridge holder of FIG. 13 in which the holder frame is in an exposure position. FIG. 15 is a partial left perspective view of the cartridge holder of FIG. 13 in which the holder frame is in a reception position.

(1) Toner Cartridge

As shown in FIG. 13, the toner cartridges 101 are provided to correspond to toners of each color. That is, the toner cartridges 101 comprise four cartridges: a yellow toner cartridge 101Y, a magenta toner cartridge 101M, a cyan toner cartridge 101C, and a black toner cartridge 101K. These four toner cartridges 101 are detachably attached to the corresponding cartridge receiving portions 166, which will be described later.

As shown in FIG. 6, the toner cartridge 101 has a substantially rectangular, box-like shape when seen from the right side, extending in the up-down direction. As shown in FIG. 8, the toner cartridge 101 integrally includes a toner storing portion 102 disposed at the upper side and a toner supplying portion 103 disposed at the lower side.

(1-1) Toner Storing Portion

The toner storing portion 102 includes a storage chassis 104 and an upper agitator 105 provided within the storage chassis 104.

The storage chassis 104 has a box-like shape that is long in the vertical direction and extends in the up-down direction in front sectional view, and the upper and lower ends are curved in a semi-circular arc shape. Toners corresponding to each color are stored in the storage chassis 104.

A grip portion 109 having a substantially U shape in sectional view is provided in the upper end of the storage chassis 104.

As shown in FIGS. 7 and 8, the upper agitator 105 is disposed below the storage chassis 104 and includes an upper agitator shaft 106 and an upper stirring member 107.

Both ends of the upper agitator shaft 106 are rotatably supported by the front and rear walls of the storage chassis 104. Both ends of the upper agitator shaft 106 protrude outward from the front and rear walls of the storage chassis 104. An upper agitator gear 108 is non-rotatably provided at the rear end of the upper agitator shaft 106 outside the rear wall of the storage chassis 104. (see FIG. 6).

The upper stirring member 107 is provided along the axial direction of the upper agitator shaft 106 and extends in the radial direction.

(1-2) Toner Supplying Portion

The toner supplying portion 103 includes an outer chassis 111 as an example of the shutter member and an inner chassis 112 as an example of the chassis that is slidably fitted to the outer chassis 111.

(a) Outer Chassis

The outer chassis 111 has a cylindrical shape that is long in the front-rear direction and is formed in a box-like shape in which the front and rear sides are closed. The upper end of the outer chassis 111 is continuously connected to the lower end of the storage chassis 104, and a communication hole 113 that allows the storage chassis 104 and the outer chassis 111 to communicate with each other is formed in the connection portion so as to extend in the front-rear direction.

As shown in FIGS. 6 and 8, an outer return port 114 having a circular shape is formed in the right portion of the outer chassis 111 at the center in the front-rear direction and the up-down direction. An outer conveying port 115 having a circular shape is formed at the upper front side of the outer return port 114.

In addition, an outer protrusion 116 as an example of the first protrusion that protrudes downward is formed at the lower end on the front side of the outer chassis 111. The outer protrusion 116 is formed in a rectangular shape in sectional view, having a large width in the front-rear direction.

An elongated hole 117 (see FIG. 6) is formed in the lower right portion of the outer chassis 111 on the rear side of the outer protrusion 116. The elongated hole 117 is formed in a substantially rectangular shape in bottom view, along the circumferential direction of the outer chassis 111 within a range of about 45 degrees from the lower end of the outer chassis 111 to the lower right portion.

(b) Inner Chassis

The inner chassis 112 is formed in a cylindrical shape extending along the inner peripheral surface of the outer chassis 111 and is received in the outer chassis 111 so as to be rotatable relative to the outer chassis 111.

The inner chassis 112 stores therein the toner supplied from the storage chassis 104.

As shown in FIGS. 7 and 8, an inner protrusion 118 as an example of the second protrusion that is slidably fitted to the elongated hole 117 is provided in the inner chassis 112. The inner protrusion 118 is formed on the rear side of the inner chassis 112 and has a rectangular shape in sectional view, having a small width in the front-rear direction. The inner protrusion 118 protrudes outward in the radial direction from the elongated hole 117.

The inner chassis 112 rotates about the outer chassis 111 within a range in which the inner protrusion 118 slides along the elongated hole 117. When the toner cartridge 101 is at the exposure position, the inner protrusion 118 is disposed at the left end of the elongated hole 117 and overlaps with the outer protrusion 116 in the front-rear direction (see FIG. 10). When the toner cartridge 101 is at the reception position, the inner protrusion 118 is disposed at the right end of the elongated hole 117 and is moved away from the outer protrusion 116 toward the upper right side (see FIG. 11).

Within the inner chassis 112, an inner return port 119 having a circular shape and an inner conveying port 120 as an example of the supply port having a circular shape are formed in an opposing relationship with the outer return port 114 and the outer conveying port 115, respectively.

The inner return port 119 is provided at the center in the front-rear direction of the inner chassis 112. The relative arrangement of the inner return port 119 to the inner protrusion 118 is set such that when the inner protrusion 118 is disposed at the right end of the elongated hole 117, the inner return port 119 is disposed at the right end of the inner chassis 112 opposed to the outer return port 114.

The inner conveying port 120 is disposed at the front side of the inner return port 119 within the inner chassis 112. The relative arrangement of the inner conveying port 120 to the inner protrusion 118 is set such that when the inner protrusion 118 is disposed at the right end of the elongated hole 117, the inner conveying port 120 is disposed at the right end of the inner chassis 112 opposed to the outer conveying port 115.

A communication port 121 is formed in the inner chassis 112 so that when the inner protrusion 118 is disposed at the right end of the elongated hole 117, the communication port 121 faces the communication hole 113 (see FIG. 11). The communication port 121 is formed in a substantially rectangular shape corresponding to the communication hole 113, extending in the front-rear direction.

A lower agitator 122 is provided in the inner chassis 112. As shown in FIGS. 7 and 8, the lower agitator 122 is disposed along the axial direction of the inner chassis 112, and includes a lower agitator shaft 123, a radial conveying blade 124, a stirring blade 125, and an axial conveying blade 126.

Both ends of the lower agitator shaft 123 are rotatably supported by the front and rear walls of the inner chassis 112. Both ends of the lower agitator shaft 123 protrude outward from the front and rear walls of the inner chassis 112. An upper agitator gear 127 is non-rotatably provided at both ends of the lower agitator shaft 123 outside the front and rear walls of the inner chassis 112. In the yellow toner cartridge 101Y, the lower agitator gear 127 is non-rotatably provided at only the rear end of the lower agitator shaft 123 (see FIG. 13).

The radial conveying blade 124 is provided at the front side of the lower agitator shaft 123 in an opposing relationship with the inner conveying port 120. The radial conveying blade 124 is formed as a blade that extends in the radial direction from the lower agitator shaft 123 and that can covey the toner in the radial direction.

The stirring blade 125 is disposed at the center of the lower agitator shaft 123 in an opposing relationship with the inner return port 119. The stirring blade 125 is formed as a blade that extends in the radial direction from the lower agitator shaft 123 and that can stir the toner without conveying in the radial direction.

The axial conveying blade 126 is disposed at the rear side of the lower agitator shaft 123. The axial conveying blade 126 is formed as a blade that extends in the radial direction from the lower agitator shaft 123 and that can convey the toner in the axial direction toward the radial conveying blade 124.

A relay gear 128 is rotatably supported by the upper end on the rear side of the rear wall of the outer chassis 111. The relay gear 128 is disposed above the lower agitator gear 127 and below the upper agitator gear 108. The lower portion of the relay gear 128 engages with the lower agitator gear 127, and the upper portion of the relay gear 128 engages with the upper agitator shaft 108.

(2) Cartridge Holder (2-1) Holder Receiving Portion

As shown in FIGS. 9 and 12, a holder receiving portion 134 that faces the process receiving portion 10 and receives the cartridge holder 13 is provided at the left portion of the main casing 2.

The holder receiving portion 134 is disposed at the right side of the process receiving portion 10 (see FIGS. 1 and 4), and is provided at the left end of the main casing 2 within a space that deepens rightward from the left side wall 16 that extends in the up-down direction. The holder receiving portion 134 includes a partition plate 135 that separates the process receiving portion 10 and the holder frame 14 from each other, a top plate 136 disposed at the upper left side of the partition plate 135, a receiver portion 137, as an example of the interlocking member, disposed at the lower left side of the partition plate 135, and a support portion 138 (see FIG. 12) disposed at both ends in the front-rear direction of the partition plate 135.

As shown in FIG. 9, the partition plate 135 is disposed along the front-rear direction between the process receiving portion 10 and the holder frame 14.

The top plate 136 is provided to extend leftward from the upper side of the partition plate 135 so that the toner cartridge 101 at the reception position can be covered from the top side. A lock member 139 is provided in the top plate 136. The lock member 139 is pivotably supported by a support shaft 140 provided in the top plate 136. A claw 141 that passes through the top plate and protrudes downward is provided at the lower end of the lock member 139. The upper end of the lock member 139 is pressed leftward by a compression spring 142 supported by the top plate 136.

The receiver portion 137 is provided in the lower portion of the partition plate 135 so as to expand leftward from the partition plate 135. The left end of the receiver portion 137 is configured as a rotation regulating portion 158 that abuts the lower end of the left plate 164 of the holder frame 14 at the exposure position (see FIG. 10).

A receiving surface that extends along the outer peripheral surface of the outer chassis 111 is formed on the upper surface of the receiver portion 137. As shown in FIG. 14, the receiving surface 143 is provided to extend in the front-rear direction and is formed in a curved concave shape that moves away from the partition plate 135 toward the left side as it goes from the top side to the down side. Specifically, the receiving surface 143 is formed in a circular arc shape in front sectional view that can receive the outer chassis 111 from the lower end to the right portion.

In the receiver portion 137, a body-side return port 144 having a circular shape and a body-side conveying port 145 having a circular shape are formed in an opposing relationship with the outer return ports 114 and the outer conveying port 115, respectively.

A plurality of body-side return ports 144, in this case, four, are provided to correspond to the outer receiving portions 114. The body-side return ports 144 are arranged at intervals in the front-rear direction and are opposed to the outer return ports 114 of the attached toner cartridges 101. The body-side return port 144 is formed at the upper end of the receiver portion 137 to penetrate the receiver portion 137 and the partition plate 135 in the left-right direction.

A plurality of body-side conveying ports 145, in this case, four, are provided to correspond to the outer conveying ports 115. The body-side conveying ports 145 are arranged at intervals in the front-rear direction and are opposed to the outer conveying ports 115 of the attached toner cartridges 101. The body-side conveying ports 145 are disposed at the upper front side of the corresponding body-side return ports 144 with a gap therebetween at the upper end of the receiver portion 137. The body-side conveying 145 is formed to penetrate the receiver portion 137 and the partition plate 135 in the left-right direction.

In addition, a fixing groove 146, as an example of the engaging portion, to which the inner protrusion 118 is fixed, and a slide groove 147 to which the outer protrusion 116 is slidably engages are formed in the receiving surface 143.

A plurality of fixing grooves 146, in this case, four, are provided to correspond to the inner protrusions 118. The fixing grooves 146 are provided at intervals in the front-rear direction and are opposed to the inner protrusions 118 of the attached toner cartridges 101. The fixing grooves 146 are formed in a substantially rectangular shape in plan view having a small width in the front-rear direction so that the inner protrusions 118 can engage with the fixing grooves 146 to regulate the movement of the inner protrusions 118 in the front-rear direction and the left-right direction.

A plurality of slide grooves 147, in this case, four, are provided to correspond to the outer protrusions 116. The slide grooves 147 are provided at intervals in the front-rear direction and are opposed to the outer protrusions 116 of the attached toner cartridges 101. The slide grooves 147 are formed in a substantially rectangular shape in plan view, that extends in the left-right direction so that the sliding movement of the outer protrusions 116 in the left-right direction (the circumferential direction of the receiving surface 143) is allowed, and that has a large width in the front-rear direction so that the movement of the outer protrusions 116 in the front-rear direction is regulated. The slide grooves 147 are disposed at the front side of the corresponding fixing grooves 146 with a gap therebetween. The right ends of the slide grooves 147 are disposed to overlap with the corresponding fixing grooves 146 in the front-rear direction.

A shutter plate 148 and a shutter guide 149 are provided in the receiving surface 143.

The shutter plate 148 has a substantially rectangular shape in plan view, extending in the front-rear direction and formed in a circular arc shape in front sectional view, corresponding to the circular arc shape of the receiving surface 143. The length of the shutter plate 148 in the front-rear direction is substantially the same as the length of the receiving surface 143 in the front-rear direction. The length of the shutter plate 148 in the circumferential direction is about two-thirds of the length of the receiving surface 143.

In the shutter plate 148, a slide hole 150 through which the inner protrusion 118 is slidably passed, and a fixing hole 151 through which the outer protrusion 116 is passed so that the outer protrusion 116 is fixed to the shutter plate 148 are formed.

plurality of slide holes 150, in this case, four, are provided to correspond to the inner protrusions 118. The slide holes 150 are provided at intervals in the front-rear direction and are opposed to the inner protrusions 118 of the attached toner cartridges 101. The slide holes 150 are formed in a substantially rectangular shape in plan view, that extends in the left-right direction so that the sliding movement of the inner protrusions 118 in the left-right direction (the circumferential direction of the receiving surface 143) is allowed, and that has a small width in the front-rear direction so that the movement of the inner protrusions 118 in the front-rear direction is regulated. The slide holes 150 are disposed to overlap with the corresponding fixing grooves 146 in the left-right direction.

A plurality of fixing holes 151, in this case, four, are provided to correspond to the outer protrusions 116. The fixing holes 151 are provided at intervals in the front-rear direction and are opposed to the outer protrusions 116 of the attached toner cartridges 101. The fixing holes 151 are disposed at the front side of the corresponding slide holes 150 with a gap therebetween. The fixing holes 151 are disposed to overlap with the left ends of the corresponding slide holes 150 in the front-rear direction. The fixing hole 151 is formed in a substantially rectangular shape in plan view having a large width in the front-rear direction so that the outer protrusions 116 are passed through the holes to regulate the movement of the outer protrusions 116 in the front-rear direction and the left-right direction. The fixing holes 151 are disposed to overlap with the slide grooves 147 in the left-right direction.

The shutter guides 149 are provided at both ends in the front-rear direction of the receiving surface 143. The shutter guides 149 are formed in an elongated stripe shape, extending in the left-right direction along the circular arc shape of the receiving surface 143.

The shutter guides 149 are opposed to both ends in the front-rear direction of the receiving surface 143 with a small gap therebetween, and the shutter plate 148 is slidably supported on the gap. Accordingly, the sliding movement of the shutter plate 148 in the left-right direction between the shutter guides 149 and the receiving surface 143 is allowed. The shutter plate 148 slides along the circumferential direction of the receiving surface 143 between a closed position (see FIG. 14) at which the upper right end of the shutter plate 148 overlaps with the upper right ends of the shutter guides 149 and a open position (see FIG. 15) at which the lower left end of the shutter plate 148 overlaps with the lower left ends of the shutter guides 149.

At the closed position, the left end of the slide hole 150 is at the fixing groove 146 and the fixing hole 151 is at the right end of the slide groove 147. At the open position, the right end of the slide hole 150 is at the fixing groove 146 and the fixing hole 151 is at the left end of the slide groove 147.

As shown in FIG. 12, the support portion 138 is disposed at both ends in the front-rear direction of the partition plate 135 in the main casing 2 and includes a front shaft portion 152 and a rear shaft portion 153.

The front shaft portion 152 is formed in a cylindrical shape and is provided to protrude backward from the front wall of the main casing 2 toward the upper side of the receiving surface 143.

The rear shaft portion 153 is formed in a cylindrical shape and is provided to protrude forward from the rear wall of the main casing 2 toward the upper side of the receiving surface 143. The rear shaft portion 153 is opposed to the front shaft portion 152 in the front-rear direction so that the cartridge holder 13 is sandwiched between the shaft portions 152 and 153.

A driving shaft 154 is inserted into the rear shaft portion 153 along the axial direction. An input gear 157 is non-rotatably connected to the driving shaft 154 that protrudes forward from the front end of the rear shaft portion 153. Accordingly, the input gear 157 is rotatably supported at the front end of the rear shaft portion 153.

A driven-side bevel gear 155 is non-rotatably connected to the driving shaft 154 that protrudes backward from the rear wall of the main casing 2. A driving-side bevel gear 156 disposed in the front-rear direction engages with the driven-side bevel gear 155 from the vertical direction. The driving bevel gear 156 is connected to a motor (not shown).

(2-2) Cartridge Holder

As described above, the cartridge holder 13 includes the holder frame 14 as an example of the supporting member. As shown in FIGS. 9 and 12, the holder frame 14 is formed in a substantially rectangular shape in sectional view so that the holder frame 14 can be received in the holder receiving portion 134. The holder frame 14 includes a front plate 161, a rear plate 162, an intermediate plate 163, a left plate 164, and a right plate 165.

The front plate 161 is disposed at the front end of the holder frame 14 in the left-right direction. The front plate 161 is formed in a substantially rectangular shape in front view that is long in the up-down direction.

The rear plate 162 is disposed at the rear end of the holder frame 14 in the left-right direction in an opposing relationship with the front plate 161 with a gap in the front-rear direction. The rear plate 162 is formed in a substantially rectangular shape in front view that is long in the up-down direction.

A plurality of intermediate plates 163, in this case, three, are provided between the front plate 161 and the rear plate 162 and are arranged in the left-right direction. The intermediate plates 163 are opposed to each other at equal intervals in the front-rear direction. The intermediate plates 163 are formed in a substantially rectangular shape in front view that is long in the up-down direction. A space between the front plate 161 and the rear plate 162 is partitioned into four subspaces at equal intervals (corresponding to the length of the toner cartridge 101 in the front-rear direction) by the three intermediate plates 163, in this exemplary embodiment.

At the exposure position, the upper edges of the front, rear, and intermediate plates 161, 162, and 163 are arranged in the horizontal direction (see FIG. 4). At the reception position, the front, rear, and intermediate plates 161, 162, and 163 are inclined downward as they go from the left edges to the right edges.

The left plate 164 is disposed at the left side of the front plate 161, the three intermediate plates 163, and the rear plate 162 along the front-rear direction and is connected to the left ends of the front plate 161, the three intermediate plates 163, and the rear plate 162. The left plate 164 is formed in a substantially rectangular shape in sectional view.

The right plate 165 is disposed at the right side of the front plate 161, the three intermediate plates 163, and the rear plate 162 along the front-rear direction and is connected to the right ends of the front plate 161, the three intermediate plates 163, and the rear plate 162. The right plate 165 is opposed to the left plate 164 with a gap (corresponding to the length of the toner cartridge 101 in the left-right direction) in the left-right direction. The right plate 165 is formed in a substantially rectangular shape in sectional view having a length the same as that of the left plate 164 in the front-rear direction and smaller than that of the left plate 164 in the up-down direction.

According to this arrangement, in the holder frame 14, four cartridge receiving portions 166 are provided which are partitioned by the front plate 161, the rear plate 162, the intermediate plates 163, the left plate 164, and the right plate 165 (see FIG. 12). The cartridge receiving portions 166 are provided to correspond to toners of each color. That is, in this exemplary embodiment, the cartridge receiving portions 166 are composed of four portions: a yellow cartridge receiving portion 166Y, a magenta cartridge receiving portion 166M, a cyan cartridge receiving portion 166C, and a black cartridge receiving portion 166K. These four cartridge receiving portions 166 are arranged in parallel in this order from the front area to the rear area. In each cartridge receiving portion 166, the toner cartridge 101 corresponding to each color is smoothly and detachably received and supported.

As shown in FIG. 3, a side cover 15 as an example of the cover member is provided with the left plate 164. The side cover 15 covers the left plate 164 from the left side. When the holder frame 14 is at the reception position, the left surface of the side cover 15 is substantially in flat contact with the left side wall 16 of the main casing 2.

A grip 173 is formed at the upper end of the side cover 15 at the center in the front-rear direction. The grip 173 is formed by depressing the side cover 15 toward the right side. The grip 173 is formed in a substantially rectangular shape in sectional view that is long in the front-rear direction.

As shown in FIGS. 9 and 12, on the upper end of the left plate 164, an engaging protrusion 174 to which the claw 141 can engage is provided at the center in the front-rear direction. The engaging protrusion 174 is formed to protrude upward from the upper edge of the left plate 164. At the reception position, the engaging protrusion 174 engages with the claw 141.

In the rear surface of the front plate 161, the front surface of the rear plate 162, and the front and rear surfaces of the intermediate plates 163, guides grooves 167 for guiding the attachment and detachment of the toner cartridge 101 are formed. The guide grooves 167 have a width that slidably receives the upper agitator shaft 106 and the lower agitator shaft 123. As shown in FIG. 9, the guide grooves 167 are formed in a linear shape that extends downward from the center in the left-right direction of the upper edges of the above surfaces to the vicinities of the lower ends of the above surfaces. The guide grooves 167 have a large width at the upper edges of the surfaces and are formed in a taper shape such that the width gradually decreases downward. The lower edges of the guide grooves 167 correspond to the position of the lower agitator shaft 123 when the lower agitator gear 127 engages with a transmission gear 169 (described later).

A transmission shaft 168 is provided at the lower ends of the intermediate plates 163 and the rear plate 162 so as to penetrate these plates in the thickness direction. The transmission shaft 168 is rotatably supported by the front and rear surfaces of the intermediate plates 163 and the rear plate 162 so as to protrude forward and backward, respectively.

Transmission gears 169 are non-rotatably connected to the front and rear ends of the transmission shaft 168 supported by the intermediate plates 163. Thus, the transmission gears 169 are rotatably supported by the front and rear surfaces of the intermediate plates 163.

The transmission gears 169 are non-rotatably connected to the front end of the transmission shaft 168 supported by the rear plate 162. Accordingly, the transmission gears 169 are rotatably supported by the front surface of the rear plate 162.

A driven gear 170 is non-rotatably connected to the rear end of the transmission shaft 168 supported by the rear plate 162 (see FIG. 12). Thus, the driven gear 170 is rotatably supported by the rear surface of the rear plate 162.

As shown in FIG. 12, a front boss 171 having a cylindrical shape that protrudes forward is provided at the lower end on the front side of the front plate 161. The front shaft portion 152 rotatably engages with the front boss 171. A rear boss 172 having a cylindrical shape that protrudes backward is provided at the lower end on the rear side of the rear plate 162. The rear shaft portion 153 rotatably engages with the rear boss 172. The front ends of the input gear 157 and the driving shaft 154, together with the rear shaft portion 153, are received in the rear boss 172.

The lower end of the holder frame 14 is rotatably supported by the holder receiving portion 134 when the front shaft portion 152 and the rear shaft portion 153 are rotatably engaged by the front boss 171 and the rear boss 172.

Accordingly, the holder frame 14 is supported such that the holder frame 14 pivots about a pivot point (the front shaft portion 152 and the rear shaft portion 153) between a reception position at which the cartridge receiving portion 166 faces the up-down direction (vertical direction) and an exposure position at which the cartridge receiving portion 166 is moved from the pivot point to face the upper left side.

(3) Attachment of Toner Cartridge

To attach the toner cartridge 101, as shown in FIG. 10, the holder frame 14 is first moved to the exposure position and then the toner cartridge 101 is attached to the corresponding cartridge receiving portion 166.

Specifically, at the reception position shown in FIG. 9, the lock member 139 is pressed to pivot the lock member 139 upward about the support shaft 140 against the biasing force of the compression spring 142. The engagement of the claw 141 with the engaging protrusion 174 is released. Thereafter, when the grip 173 is pulled toward the left side, the holder frame 14 is pivoted leftward about the lower end and is disposed at the exposure position at which the upper end is exposed from the left side wall 16.

At the exposure position, the toner cartridge 101 is moved above the cartridge receiving portion 166.

At this time, in the toner cartridge 101, as shown in FIG. 6, the inner protrusion 118 is disposed at the left end of the elongated hole 117. That is, as shown in FIG. 8, the inner protrusion 118 and the outer protrusion 116 overlap with each other in the front-rear direction at the lower end of the toner cartridge 101 (that is, at the end on the downstream side in the attachment direction of the toner cartridge 101). Accordingly, the inner return port 119 and the inner conveying port 120 are on the downstream side of the outer return port 114 and the outer conveying port 115, and the inner return port 119 and the inner conveying port 120 are closed by the outer chassis 111. In addition, the communication port 121 is on the right side of the communication hole 113, and the communication port 121 is closed by the inner chassis 112.

In the receiver portion 137, as shown in FIG. 14, the shutter plate 148 is disposed at the closed position, and the left end of the slide hole 150 and the fixing groove 146 in mutually opposing relationship and the fixing hole 151 and the right end of the slide groove 147 in mutually opposing relationship overlap with each other in the front-rear direction at the deepest portion of the receiver portion 143 (that is, at the end on the downstream side in the attachment direction of the toner cartridge 101).

Thereafter, the lower agitator shaft 123 and the upper agitator shaft 106 are sequentially inserted into the guide grooves 167 provided at both sides in the front-rear direction of the cartridge receiving portion 166. Then, the toner cartridge 101 is pushed in a direction toward the lower right side until the lower agitator gear 127 engages with the transmission gear 169.

Then, as shown in FIGS. 10 and 13, the inner protrusion 118 is inserted into the left end of the slide hole 150 and thereafter is fitted to the fixing groove 146. At the same time, the outer protrusion 116 is inserted into the fixing hole 151 and thereafter is fitted to the right end of the slide groove 147. The lower agitator gear 127 engages with the transmission gear 169.

Thus, the toner cartridges 101 are attached to the corresponding cartridge receiving portions 166 and are supported by the cartridge holder 13. At the exposure position, the toner cartridges 101 are exposed from the main casing 2 toward the left side, and the upper portions of the toner cartridges 101 are exposed from the left side wall 16.

When the grip 173 is gripped to pull the side cover 15 toward the left side, as shown in FIG. 11, the holder frame 14 is pivoted leftward about the lower end and is disposed at the reception position at which the upper end is received in the left side wall 16.

During a period in which the holder frame 14 is pivoted from the exposure position to the reception position, the relative movement of the inner protrusion 118 to the receiver portion 137 is regulated by the fixing groove 146. On the other hand, the relative movement of the outer protrusion 116 to the receiver portion 137 along the slide groove 147 is allowed. Accordingly, the outer protrusion 116 is pivoted from the right side to the left side so as to be moved away from the inner protrusion 118 along the slide groove 147 and is finally disposed at the left end of the slide groove 147. Accordingly, the outer chassis 111 slides downward relative to the inner chassis 112. At the reception position, the inner return port 119 and the inner conveying port 120 are opposed to the outer return port 114 and the outer conveying port 115. In addition, the communication hole 113 is opposed to the communication port 121.

The relative movement of the outer protrusion 116 to the shutter plate 148 is regulated by the fixing hole 151. On the other hand, the relative movement of the inner protrusion 118 to the shutter plate 148 along the slide hole 150 is allowed. Thus, with the pivoting operation of the outer protrusion 116 from the right side to the left side, as shown in FIG. 15, the shutter plate 148 slides downward relative to the receiving surface 143. At the reception position, the inner protrusion 118 is disposed at the right end of the slide hole 150, and the shutter plate 148 is disposed at the open position. The body-side return port 144 and the body-side conveying port 145 are opposed to the outer return port 114 and the outer conveying port 115.

When the holder frame 14 is moved to the reception position, as shown in FIG. 11, the claw 141 engages with the engaging protrusion 174 against the biasing force of the compression spring 142 so that the holder frame 14 is locked at the reception position. At the reception position, the toner cartridges 101 are received in the main casing 2. In the reception position, the toner cartridge 101 is attached to the main casing 2 and the developing casing 60.

When the toner cartridge 101 is attached to the developing casing 60, the inner return port 119 and the inner conveying port 120 are disposed to communicate and overlap with the body-side return port 144 and the body-side conveying port 145 in the width direction via the outer return port 114 and the outer conveying port 115, respectively. In addition, the inner return port 119 and the inner conveying port 120 are disposed to overlap with the return auger 65 and the conveying auger 64, respectively, in the width direction (horizontal direction).

In addition, the communication hole 113 and the communication port 121 are opposed to each other so the storage chassis 104 and the inner chassis 112 are communicated with each other.

The toner cartridge 101 and the cartridge holder 13 are opposed to the return auger 65 and the developing roller 61 disposed in parallel to the conveying auger 64 in the axial direction (left-right direction) of the developing roller 61.

(4) During Image Forming Operation

During image forming operations, as shown in FIG. 13, a driving force of a motor (not shown) is transmitted from the driving-side bevel gear 156 to the driven-side bevel gear 155. The driving force transmitted to the driven-side bevel gear 155 is transmitted from the input gear 157 to the driven gear 170 and again to the transmission gear 169 of the rear plate 162. The driving force transmitted to the transmission gear 169 of the rear plate 162 is sequentially transmitted to the black toner cartridge 101K, the cyan toner cartridge 101C, the magenta toner cartridge 101M, and the yellow toner cartridge 101Y.

In the toner cartridges 101, the driving force is transmitted in the following manner. The driving force is first transmitted to the transmission gear 169 on the rear side and then from the transmission gear 169 on the rear side to the lower agitator gear 127 on the rear side that engages with the gear 169. Accordingly, with the rotation of the lower agitator shaft 123, the driving force is transmitted to the lower agitator gear 127 on the front side. The driving force transmitted to the lower agitator gear 127 on the front side is transmitted to the transmission gear 169 on the front side that engages with the gear 127, thus causing the transmission shaft 168 to rotate. The driving force is transmitted to the transmission gear 169 on the rear side of the cartridge receiving portion 166 disposed on the front side.

The driving force transmitted to the lower agitator gear 127 on the rear side is transmitted to the relay gear 128 that engages with the gear 127. Thereafter, the driving force is transmitted to the upper agitator gear 108 that engages with the gear 128, and the upper agitator shaft 106 is rotated.

Accordingly, when the upper agitator shaft 106 and the lower agitator shaft 123 are rotated, in the toner cartridge 101, a toner stored in the storage chassis 104 falls by its own weight while being stirred by the upper stirring member 107 and is supplied to the inner chassis 112 via the communication hole 113 and the communication port 121.

Within the inner chassis 112, the toner is stirred by the axial conveying blade 126 in the circumferential direction so that the toner is not discharged via the inner return port 119. The toner is conveyed by the axial conveying blade 126 in the axial direction toward the radial conveying blade 124. Then, the toner is conveyed by the radial conveying blade 124 in the radial direction and then discharged via the inner conveying port 120.

The discharged toner is conveyed to the conveying auger 64 via the inner conveying port 120, the outer conveying port 115, and the body-side conveying port 145. Thereafter, as described above, the toner is supplied to the supply roller 63. The toner that was not supplied to the supply roller 63 is returned by the return auger 65 to the inner chassis 112 via the body-side return port 144, the outer return port 114, and the inner return port 119.

(5) Detachment of Toner Cartridge

To detach the toner cartridge 101, first, the lock member 139 is pressed to pivot the lock member 139 upward about the support shaft 140 against the biasing force of the compression spring 142. Then, the engagement of the claw 141 with the engaging protrusion 174 is released. Thereafter, when the grip 173 is pulled toward the left side, the holder frame 14 is pivoted leftward about the lower end and is disposed at the exposure position at which the upper end is exposed from the left side wall 16.

During a period in which the holder frame 14 is pivoted from the exposure position to the reception position, the relative movement of the inner protrusion 118 to the receiver portion 137 is regulated by the fixing groove 146. On the other hand, the relative movement of the outer protrusion 116 to the receiver portion 137 along the slide groove 147 is allowed. Thus, the outer protrusion 116 is pivoted from the left side to the right side so as to be moved toward the inner protrusion 118 along the slide groove 147 and is finally disposed at the right end of the slide groove 147. Accordingly, the outer chassis 111 slides upward relative to the inner chassis 112. At the exposure position, the inner return port 119 and the inner conveying port 120 are opposed to the outer chassis 111 and close. In addition, the communication hole 113 is opposed to the inner chassis 112 and closes.

The relative movement of the outer protrusion 116 to the shutter plate 148 is regulated by the fixing hole 151. On the other hand, the relative movement of the inner protrusion 118 to the shutter plate 148 along the slide hole 150 is allowed. Accordingly, with the pivoting operation of the outer protrusion 116 from the left side to the right side, as shown in FIG. 14, the shutter plate 148 slides upward relative to the receiving surface 143. At the exposure position, the inner protrusion 118 is disposed at the left end of the slide hole 150, and the shutter plate 148 is disposed at the closed position. The body-side return port 144 and the body-side conveying port 145 are opposed to the shutter plate 148 and close.

At the exposure position, as shown in FIG. 10, the rotation regulating portion 158 of the receiver portion 137 abuts the lower end of the left plate 164 of the holder frame 14. When the toner cartridge 101 is attached to the cartridge receiving portion 166, the outer protrusion 116 engages with the right end of the slide groove 147. Thus, the attachment and detachment direction (angle) of the toner cartridge 101 at the exposure position is determined by the engagement. In this exemplary embodiment, the attachment and detachment direction X1 of the toner cartridge 101 is set to 45 degrees about the vertical direction. This angle is determined as an angle between the attachment and detachment direction X1 (specifically, the direction along the guide groove 167) and the line X2 that extends in the vertical direction from the pivot point of the toner cartridge 101 (specifically, from the rotation center of the inner chassis 112).

Accordingly, the toner cartridge 101 is exposed from the main casing 2 toward the left side. When the toner cartridge 101 is drawn from the cartridge receiving portion 166 toward the upper left side, the lower agitator shaft 123 and the upper agitator shaft 106 are guided along the guide groove 167, and the toner cartridge 101 is detached from the cartridge receiving portion 166. Accordingly, the toner cartridge 101 is detached from the main casing 2 and the developing casing 60.

3. Effects of the Exemplary Embodiment

In the color laser printer 1, the cartridge holder 13 for supporting the toner cartridge 101 pivots about the lower end between the reception position at which the toner cartridge 101 is received in the main casing 2 and the exposure position at which the toner cartridge 101 is exposed from the main casing 2.

Thus, when the cartridge holder 13 is pivoted from the exposure position to the reception position, the toner cartridge 101 is received in the main casing 2. When the cartridge holder 13 is pivoted from the reception position to the exposure position, the upper portion of the toner cartridge 101 is exposed from the left side wall 16. Accordingly, the toner cartridge 101 can be attached to and detached from the cartridge holder 13. Thus, in the main casing 2, it is possible to provide the FB unit 7 in the upper space of the toner cartridge 101 received at the reception position, and the space can be effectively utilized.

As a result, it is possible to allow smooth attachment and detachment of the toner cartridge 101 to and from the cartridge holder 13 with a simple operation such as an operation of pivoting the cartridge holder 13. It is also possible to provide the FB unit 7 in the upper space of the toner cartridge 101 received at the reception position and to thus effectively utilize the space. By using such an arrangement that the cartridge holder 13 is pivoted, it is possible to freely set the attachment and detachment direction of the cartridge holder 13 at the time of design. As a result, it is possible to effectively utilize the space adjacent to the color laser printer 1.

In the color laser printer 1, at the exposure position, the toner cartridge 101 is supported by the cartridge holder 13 so that the attachment and detachment direction X1 of the toner cartridge 101 forms an angle of 45 degrees about the vertical direction. Thus, it is possible to simplify the attachment and detachment of the toner cartridge 101 to and from the cartridge holder 13.

At the reception position, the toner cartridge 101 and the cartridge holder 13 are opposed to the return auger 65 and the developing roller 61 disposed in parallel to the conveying auger 64 in the axial direction (left-right direction) of the developing roller 61. Thus, it is possible to decrease the size of the main casing 2 in the up-down direction while storing a greater amount of toner in the toner cartridge 101, compared with the case in which the toner cartridge 101 and the cartridge holder 13 are opposed to the developing roller 61 in the up-down direction perpendicular to the axial direction of the developing roller 61.

In particular, even though the color laser printer 1 may be a tandem-type color laser printer having a plurality of photosensitive drums 48, it is possible to form such a tandem-type color laser printer in a very compact size. Compared with a case in which the toner cartridge 101 is slid and drawn out in the horizontal direction from the left side wall 16 of the main casing 2, the attachment and detachment of the toner cartridge 101 according to this exemplary embodiment uses a smaller space at the outside of the left side wall 16. Thus, the space can be effectively utilized.

When the cartridge holder 13 is pivoted from the exposure position to the reception position, the relative movement of the inner protrusion 118 to the receiver portion 137 is regulated by the fixing groove 146, and the relative movement of the outer protrusion 116 to the receiver portion 137 along the slide groove 147 is allowed. Therefore, the outer chassis 111 is slid downward relative to the inner chassis 112, and the inner return port 119 and the inner conveying port 120 are opposed to the outer return port 114 and the outer conveying port 115. When the cartridge holder 13 is pivoted from the reception position to the exposure position, the outer chassis 111 is slid upward relative to the inner chassis 112, and the inner return port 119 and the inner conveying port 120 are opposed to the outer chassis 111 and close.

When the cartridge holder 13 is pivoted from the exposure position to the reception position, the relative movement of the outer protrusion 116 to the shutter plate 148 is regulated by the fixing hole 151, and the relative movement of the inner protrusion 118 to the shutter plate 148 along the slide hole 150 is allowed. Therefore, the shutter plate 148 is slid downward relative to the receiving surface 143, and the body-side return port 144 and the body-side conveying port 145 are opposed to the outer return port 114 and the outer conveying port 115. When the cartridge holder 13 is pivoted from the reception position to the exposure position, the shutter plate 148 is slid upward relative to the receiving surface 143, and the body-side return port 144 and the body-side conveying port 145 are opposed to the shutter plate 148 and close.

Thus, with a simple operation such as an operation of pivoting the cartridge holder 13, at the reception position, the inner return port 119 and the inner conveying port 120 are communicated with the body-side return port 144 and the body-side conveying port 145 via the outer return port 114 and the outer conveying port 115. At the exposure position, the inner return port 119 and the inner conveying port 120 are closed by the outer chassis 111, and the body-side return port 144 and the body-side conveying port 145 are closed by the shutter plate 148.

As a result, with a simple arrangement, it is possible to interlock the pivoting operation of the cartridge holder 13, the opening and closing operation of the outer chassis 111 with respect to the inner return port 119 and the inner conveying port 120, and the opening and closing operation of the shutter plate 148 with respect to the body-side return port 144 and the body-side conveying port 145 with each other. Thus, it is possible to improve the operability.

The inner protrusion 118 and the outer protrusion 116 overlap with each other in the front-rear direction at the lower end of the toner cartridge 101 (that is, at the end on the downstream side in the attachment direction of the toner cartridge 101). Thus, when the toner cartridge 101 is attached to the cartridge holder 13, the inner protrusion 118 can be securely engaged with the fixing groove 146 by being inserted into the left end of the slide hole 150. In addition, the outer protrusion 116 can be securely engaged with the right end of the slide groove 147 by being inserted into the fixing hole 151.

As a result, it is possible to more securely interlock the pivoting operation of the cartridge holder 13, the opening and closing operation of the outer chassis 111 with respect to the inner return port 119 and the inner conveying port 120, and the opening and closing operation of the shutter plate 148 with respect to the body-side return port 144 and the body-side conveying port 145 with each other, while providing improved operability.

In the color laser printer 1, with the pivoting operation of the cartridge holder 13, the outer chassis 111 of each of the toner cartridges 101 and the shutter plates 148 corresponding to the toner cartridges 101 are opened and closed in a bundle. Thus, it is not necessary to open or close the outer chassis 111 and the shutter plates 148 of the toner cartridges 101 on a one-by-one basis, thus providing improved operability.

Since in the color laser printer 1, the cartridge holder 13 is provided with the side cover 15. The color laser printer 1 can have a clean outer appearance.

4. Modifications

In the above-described exemplary embodiment, although an intermediate transfer, tandem-type color laser printer 1 is illustrated, an image forming apparatus according to another exemplary embodiment of the present invention may be configured as a direct, tandem-type color laser printer or a monochromatic laser printer.

According to the exemplary embodiments of the present invention, the supporting member for supporting the cartridge pivots about the one end between a reception position at which the cartridge is received in the device body and an exposure position at which the cartridge is exposed from the device body. Thus, when the supporting member is pivoted from the exposure position to the reception position, the cartridge is received in the device body. When the supporting member is pivoted from the reception position to the exposure position, the cartridge is exposed from the device body. Accordingly, the cartridge can be attached to and detached from the supporting member. Thus, in the device body, it is possible to effectively utilize the space on a side opposite to the pivot position of the cartridge received at the reception position.

As a result, it is possible to allow smooth attachment and detachment of the cartridge to and from the supporting member with a simple operation such as an operation of pivoting the supporting member. It is also possible to effectively utilize the space that is adjacent to the cartridge received at the reception position and on a side opposite to the pivot position of the cartridge. By using such an arrangement that the supporting member is pivoted, it is possible to freely set the attachment and detachment direction of the cartridge at the time of design. As a result, it is possible to effectively utilize the space adjacent to the image forming device.

According to the exemplary embodiments of the present invention described above, the lower end of the supporting member is rotatably supported by the main body and exposes the upper portion of the cartridge from the side wall at the exposure position. Thus, it is possible to effectively utilize an upper space of the cartridge.

According to the exemplary embodiments, at the exposure position, the cartridge is supported by the supporting member so that the attachment and detachment direction of the cartridge forms an angle smaller than 60 degrees about the vertical direction. Thus, it is possible to simplify the attachment and detachment of the cartridge to and from the supporting member.

According to the exemplary embodiments, the supporting member and the cartridge are disposed to face the developer carrying member in the longitudinal direction of the developer carrying member. Thus, it is possible to decrease the size of the main body in the up-down direction while storing a greater amount of toner in the cartridge, compared with the case in which the supporting member and the cartridge are disposed to face the developer carrying member in the up-down direction perpendicular to the longitudinal direction of the developer carrying member.

According to the exemplary embodiments of the present invention described above, the image forming apparatus is a tandem-type color image forming apparatus having a plurality of image carrying members. However, it is possible to form such a tandem-type color image forming apparatus in a very compact size.

According to the exemplary embodiments of the present invention, when the supporting member is pivoted from the exposure position to the reception position, the interlocking member allows the shutter member to open the opening. When the supporting member is pivoted from the reception position to the exposure position, the interlocking member allows the shutter member to close the opening. Thus, it is possible to securely open and close the opening at the reception position and the exposure position, respectively, with a simple operation such as an operation of pivoting the supporting member, and to thus improve the operability.

According to the exemplary embodiments of the invention, the engaging portion of the interlocking member allows or regulates the movement of the protrusion of the cartridge that engages with the engaging portion in accordance with the pivoting operation of the supporting member.

According to the exemplary embodiments of the invention, when the first protrusion provided at one of the inner chassis and the outer chassis and the second protrusion provided at the other thereof engage with the engaging portion and when the supporting member pivots, the movement of one of the first and second protrusions is allowed and the movement of the other is regulated. Thus, it is possible to securely interlock the pivoting operation of the supporting member and the opening and closing operation of the shutter member with a simple arrangement.

According to the exemplary embodiments of the present invention, the protrusion is disposed downstream in the attachment direction of the cartridge. Thus, when the cartridge is attached to the supporting member, the protrusion securely engages with the engaging portion. As a result, it is possible to secure interlock the pivoting operation of the supporting member and the opening and closing operation of the shutter member while providing improved operability.

According to the exemplary embodiments of the present invention, each of the cartridges has the chassis and the shutter member, and the interlocking member opens and closes all the shutter members in a bundle with the pivoting operation of the supporting member. Thus, it is not necessary to open or close the shutter members of the cartridges on a one-by-one basis, thus providing improved operability.

According to the exemplary embodiments of the present invention, the supporting member is provided with the cover member. The image forming apparatus can have a clean outer appearance.

According to the exemplary embodiments of the present invention, the each cartridge has a chassis for accommodating the developer, and the chassis has two openings through which the developer can pass. Therefore, it is possible to smoothly perform the conveyance of the developer to the cartridge.

According to the exemplary embodiments of the present invention, one of the two openings is provided for supplying the developer from the cartridge and the other opening is provided for collecting the developer in the cartridge. Therefore, the developer can be supplied from the cartridge through the one opening and the developer that is not accommodated in the cartridge can be collected in the other cartridge.

According to the exemplary embodiments of the present invention, a rotation axis of the supporting member is disposed on one end portion of the supporting member in a longitudinal direction of the supporting member, and the each cartridge can be attached to and detached from a side of the other end portion of the supporting member in the longitudinal direction of the supporting member.

According to the exemplary embodiments of the present invention, the plurality of image carrying members are arranged in a predetermined direction, and wherein the each cartridge has a long side wall along a direction in which the cartridge can be attached to and detached with respect to the supporting member, and a longitudinal direction of the cartridge is substantially orthogonal to the predetermined direction of the image carrying members and a longitudinal direction of the developer carrying members when the cartridges are disposed in the reception position. Therefore it is possible to efficiently use a space in the image forming apparatus.

According to the exemplary embodiments of the present invention, the plurality of image carrying members are arranged in a predetermined direction, and a rotation axis of the supporting member is substantially parallel to the predetermined direction of the image carrying members. Therefore, it is possible to efficiently use a space in the image forming apparatus.

According to the exemplary embodiments of the present invention, a rotation axis of the supporting member is substantially orthogonal to a longitudinal direction of the developer carrying members and a longitudinal direction of the cartridges.

According to the exemplary embodiments of the prevent invention, when the cartridges are disposed in the reception position, a rotation axis of the supporting member is disposed in an end portion of the each cartridge in a longitudinal direction of the cartridge and a motive energy transfer member, which transfers motive energy to an agitation member of the cartridge, is disposed close to the end portion of the cartridge. Therefore, it is possible to efficiently use a space in the image forming apparatus and to efficiently transfer the motive energy to the agitation member of the cartridge.

According to the exemplary embodiment of the present invention, the apparatus further comprises a belt having a surface opposite to the image carrying members. And, the plurality of image carrying members are arranged in a predetermined direction, an orthogonal plane, which is orthogonal to the surface of the belt and the predetermined direction, is arranged so as to overlap to the image carrying members and the cartridges. Therefore, it is possible to convey the developer to the image carrying members from the cartridges in a short distance.

What is claimed is:

1. An image forming apparatus comprising:

a main body;

a cartridge having two openings through which developer can pass, the cartridge configured to store the developer; and a supporting member configured to receive the cartridge, an end of the supporting member being rotatably supported by the main body, the supporting member configured to pivot between a first position at which the cartridge is able to be received into the main body and a second position at which the cartridge is able to be attached to and detached from the main body.

2. The image forming apparatus according to claim 1, further comprising:

a side cover configured to cover the supporting member, wherein the side cover is rotatably supported by the main body.

3. The image forming apparatus according to claim 1, wherein a rotation axis of the supporting member is disposed in one end portion of the supporting member in a longitudinal direction of the supporting member, and wherein the cartridge is configured to be attached to and detached from a side of another end portion of the supporting member in the longitudinal direction of the supporting member.

4. The image forming apparatus according to claim 1, further comprising:

a developer carrying member configured to carry the developer supplied from the cartridge, wherein a rotation axis of the supporting member is substantially orthogonal to a longitudinal direction of the developer carrying member and a longitudinal direction of the cartridge.

5. An image forming apparatus comprising:

a main body;

a cartridge configured to store developer;

a supporting member configured to receive the cartridge, an end of the supporting member being rotatably supported by the main body, the supporting member configured to pivot between a first position at which the cartridge is able to be received into the main body and a second position at which the cartridge is able to be attached to and detached from the main body; and a side cover configured to cover the supporting member, wherein the cartridge comprises:

a first opening configured to supply the developer from the cartridge; and a second opening configured to collect the developer into the cartridge.

6. The image forming apparatus according to claim 5, wherein the side cover is rotatably supported by the main body.

7. The image forming apparatus according to claim 5, wherein a rotation axis of the supporting member is disposed in one end portion of the supporting member in a longitudinal direction of the supporting member, and wherein the cartridge is configured to be attached to and detached from a side of another end portion of the supporting member in the longitudinal direction of the supporting member.

8. The image forming apparatus according to claim 5, further comprising:

a developer carrying member configured to carry the developer supplied from the cartridge, wherein a rotation axis of the supporting member is substantially orthogonal to a longitudinal direction of the developer carrying member and a longitudinal direction of the cartridge.

9. An image forming apparatus comprising:

a main body;

a cartridge configured to store developer, the cartridge having an agitation member;

a supporting member configured to receive the cartridge, an end of the supporting member being rotatably supported by the main body, the supporting member configured to pivot between a first position at which the cartridge is able to be received into the main body and a second position at which the cartridge is able to be attached to and detached from the main body, a rotation axis of the supporting member being disposed in an end portion of the cartridge in a longitudinal direction of the cartridge; and a motive energy transfer member configured to transfer motive energy to the agitation member, the motive energy transfer member disposed close to the end portion of the cartridge.

10. The image forming apparatus according to claim 9, further comprising:

a side cover configured to cover the supporting member.

11. The image forming apparatus according to claim 10, wherein the side cover is rotatably supported by the main body.

12. The image forming apparatus according to claim 9, wherein the cartridge has a first opening for supplying the developer from the cartridge.

13. The image forming apparatus according to claim 12, wherein the cartridge has a second opening for collecting the developer into the cartridge.

14. The image forming apparatus according to claim 9, wherein a rotating axis of the supporting member is disposed in one end portion of the supporting member in a longitudinal direction of the supporting member, and wherein the cartridge is configured to be attached to and detached from a side of another end portion of the supporting member in the longitudinal direction of the supporting member.

15. The image forming apparatus according to claim 9, further comprising: a developer carrying member configured to carry the developer supplied from the cartridge, wherein a rotation axis of the supporting member is substantially orthogonal to a longitudinal direction of the developer carrying member and a longitudinal direction of the cartridge.

16. An image forming apparatus comprising:

a main body;

a cartridge configured to store developer, the cartridge having a first end and a second end opposing the first end in a longitudinal direction of the cartridge, the cartridge having a grip portion at the first end of the cartridge; and a supporting member configured to receive the cartridge, an end of the supporting member being rotatably supported by the main body, the supporting member configured to pivot between a first position at which the cartridge is able to be received into the main body and a second position at which the cartridge is able to be attached to and detached from the main body, a rotation axis of the supporting member being disposed in the vicinity of the second end of the cartridge when the supporting member receives the cartridge.

17. The image forming apparatus according to claim 16, wherein the cartridge further has an agitation member, and wherein the image forming apparatus includes a motive energy transfer member configured to transfer motive energy to the agitation member, the motive energy transfer member being disposed close to the second end of the cartridge when the supporting member receives the cartridge.

18. The image forming apparatus according to claim 16, further comprising;

a side cover configured to cover the supporting member.

19. The image forming apparatus according to claim 18, wherein the side cover is rotatably supported by the main body, a rotation axis of the side cover being disposed in the vicinity of the second end of the cartridge when the supporting member receives the cartridge.

* * * * *